US005665528A

United States Patent [19]

Wariishi et al.

[11] Patent Number: 5,665,528

[45] Date of Patent: Sep. 9, 1997

[54] SILVER HALIDE PHOTOGRAPHIC MATERIAL CONTAINING DYE

[75] Inventors: Koji Wariishi; Keisuke Matsumoto; Keiichi Suzuki, all of Kanagawa, Japan

[73] Assignee: Fuji Photo Film Co., Ltd., Kanagawa, Japan

[21] Appl. No.: 513,184

[22] Filed: Aug. 9, 1995

[30] Foreign Application Priority Data

Aug. 9, 1994 [JP] Japan ..... 6-186949

[51] Int. Cl.[6] ..... G03C 1/83

[52] U.S. Cl. ..... 430/516; 430/513; 430/522; 430/559

[58] Field of Search ..... 430/513, 516, 430/522, 559

[56] References Cited

U.S. PATENT DOCUMENTS 5,288,600 2/1994 Yamanouchi et al. ..... 430/522

5,296,344 3/1994 Jimbo et al. ..... 430/522

*Primary Examiner*—Lee C. Wright

*Attorney, Agent, or Firm*—Sughrue, Mion, Zinn, Macpeak & Seas

[57] ABSTRACT

A silver halide photographic material comprises at least one silver halide emulsion layer and at least one non-light-sensitive hydrophilic colloidal layer provided on a support. The silver halide emulsion layer or the hydrophilic colloidal layer contains a new dye represented by the formula (I):

(I)

in which L is a single bond, a divalent aliphatic group, a divalent aromatic group or a combination thereof; A is an acidic nucleus; each of $R^1$, $R^3$, $R^4$, $R^5$ and $R^6$ independently is hydrogen or a substituent group; $R^2$ is a substituent group; m is an integer of 0 to 4; n is 0 or 1; and X is an electron attractive group having a Hammett's substituent constant ($\sigma_m$) of 0.3 to 1.5.

17 Claims, No Drawings

SILVER HALIDE PHOTOGRAPHIC MATERIAL CONTAINING DYE

FIELD OF THE INVENTION

The present invention relates to a silver halide photographic material. The invention particularly relates to a silver halide photographic material containing a dye.

BACKGROUND OF THE INVENTION

A silver halide photographic material comprises at least one silver halide emulsion layer and at least one non-light-sensitive hydrophilic colloidal layer provided on a support. The silver halide emulsion layer or the hydrophilic colloidal layer often contains a dye, which absorbs a light of a specific wavelength.

A color filter layer is provided on a silver halide emulsion layer to control the spectrum of light incident on the emulsion layer. The filter layer may be provided between two or more emulsion layers. For example, a yellow filter layer is usually provided between a blue sensitive layer and red and green sensitive layers in a multi-layered color photographic material.

An antihalation layer is provided between a support and an emulsion layer or on the backing side of the support. Light incident on an emulsion layer is scattered by the emulsion layer, other layers or a support. The scattered light is reflected at the interface between the support and the emulsion layer or at the backing surface of the support. The scattered and reflected light is incident again on the emulsion layer to cause image blurring, namely halation. The antihalation layer prevents such a problem of halation. The antihalation layer may also be provided between two or more emulsion layers in a multi-layered photographic material.

A silver halide emulsion layer or a hydrophilic colloidal layer may be colored to prevent irradiation, which is caused by scattered light. The irradiation reduces the sharpness of the obtained image.

The above-described layers have been usually colored by fine colloidal silver grains. However, the colloidal silver grains have an adverse influence (e.g., contact fog) on a neighboring silver halide emulsion layer.

Organic dyes have recently been used in place of the colloidal silver to solve the problem. The dyes must satisfy the following conditions:

(1) The dyes have a spectral absorption suitable for their use.

(2) The dyes are inactive chemical compounds in photographic reactions. For example, the dyes should not have adverse chemical effects on silver halide emulsion layers. The adverse effects include reduction of sensitivity, regression of latent image and fog.

(3) The dyes are bleached or dissolved in a processing solution or a washing water. The dyes should not remain in the processed photographic material.

(4) The dyes are not diffused from the dyed layer to the other layers.

(5) The dyes are stable in a solution or in a photographic material. The color formed by the dyes should not be faded nor discolored.

The condition (4) is particularly necessary where the dyes are used in a filter layer or an antihalation layer provided on the side of the emulsion layers. The diffused dyes cause adverse spectral effects on the other layers. Further, the functions of the filter layer or the antihalation layer are degraded by the diffused dyes. However, the dyes tend to be diffused because the colored layer and the other layers are contacted under wet conditions when the layers are formed. Therefore, the photographic materials have been improved to prevent diffusion of the dyes.

For example, Japanese Patent Provisional Publications No. 56(1981)-12639, No. 63(1988)-197943, European Patents No. 15601, No. 274723, No. 299435 and U.S. Pat. No. 4,950,586 disclose a process of forming a colored layer with particles of a solid dye that is insoluble in water.

Further, Japanese Patent Provisional Publications No. 55(1980)-155351, No. 3(1991)-144438, No. 5(1993)-209133, Japanese Patent Publication No. 48(1973)-42175, European Patent Publication No. 524594A and U.S. Pat. No. 4,923,788 disclose dyes preferably used in the form of solid particles. The dyes have a chemical structure wherein an acidic nucleus and a five-membered heterocyclic ring are joined with a methine chain.

Furthermore, Japanese Patent Provisional Publications No. 3(1991)-167546 and No. 5(1993)-86056 disclose photographic dyes comprising a pyrazolone ring and an indole (or pyrrole) ring.

SUMMARY OF THE INVENTION

The applicants have further studied the known dyes. As a result, the applicants note that the problems still remain in the dyes.

The dyes should be bleached or removed at a development process. A recent development system requires a rapid processing. The dyes cannot be quickly bleached or removed. Further, it is sometimes difficult to bleach or removed the known dyes under conditions that the compositions of the processing solutions or the silver halide emulsions are changed.

The known dyes are still diffused to the other layers. The diffused dyes reduce the sensitivity of the photographic material.

Further, dyes contained in a filter layer should have an appropriate spectral absorption. For example, yellow dyes in the yellow filter layer preferably absorb only blue light. If the filter layer absorbs another light, the sensitivity of the emulsion layer under the filter layer is reduced.

An object of the present invention is to provide a silver halide photographic material containing a new dye, which can be quickly decolorized.

Another object of the invention is to provide a silver halide photographic material containing a new dye, which is scarcely diffused to the other layers.

A further object of the invention is to provide a silver halide photographic material containing a new dye, which has a spectral absorption suitable in a yellow filter layer.

The present invention provides a silver halide photographic material comprising at least one silver halide emulsion layer and at least one non-light-sensitive hydrophilic colloidal layer provided on a support, wherein the silver halide emulsion layer or the hydrophilic colloidal layer contains a dye represented by the formula (I):

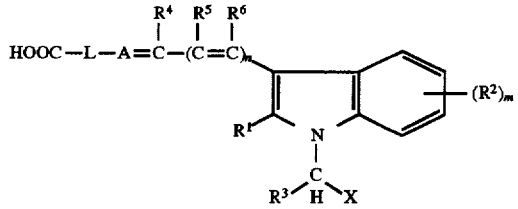

(I)

in which L is a single bond, a divalent aliphatic group, a divalent aromatic group or a combination thereof; A is an acidic nucleus; $R^1$ is hydrogen, an aliphatic group, an aromatic group, an alkoxycarbonyl group, an aryloxycarbonyl group, an alkoxy group, an aryloxy group, an acyloxy group, a sulfonyloxy group, a carbamoyloxy group, a carbamoyl group, a halogen atom, hydroxyl or carboxyl; R2 is an aliphatic group, an aromatic group, an acyl group, a sulfonyl group, an alkoxycarbonyl group, an aryloxycarbonyl group, an alkoxy group, an aryloxy group, an acyloxy group, a sulfonyloxy group, a carbamoyloxy group, amino, a substituted amino group, a heterocyclic group, an amido group, a carbamoyl group, a sulfonamido group, a halogen atom, hydroxyl, nitro, cyano or carboxyl; $R^3$ is hydrogen, an aliphatic group, an aromatic group or a halogen atom; each of $R^4$, $R^5$ and $R^6$ independently is hydrogen, an alkyl group, cyano or a halogen atom; m is an integer of 0 to 4; when m is 2, 3 or 4, the groups represented by $R^2$ may be different from each other; n is 0 or 1; and X is an electron attractive group having a Hammett's substituent constant ($\sigma_m$) of 0.3 to 1.5.

The dye represented by the formula (I) is characterized by carboxyl group attached to L or A and the electron attractive group (X). The electron attractive group has a function of accelerating the reaction of the dye with a nucleophilic agent contained in a processing solution (hydroxyl ion and sulfite ion). The electron attractive group seems to reduce the electron density at the reaction site (conjugated with nitrogen atom of the indole ring) for the nucleophilic agent to accelerate the reaction.

DETAILED DESCRIPTION OF THE INVENTION

The new dye represented by the formula (I) is described below.

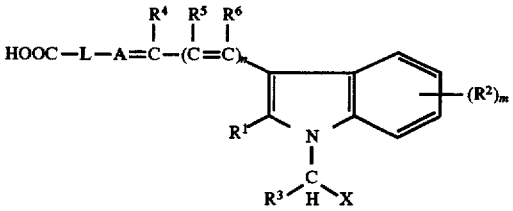

In the formula (I), L is a single bond, a divalent aliphatic group, a divalent aromatic group or a combination thereof. The single bond means that carboxyl is directly attached to A. The divalent aliphatic group includes an alkylene group, a substituted alkylene group, an alkenylene group, a substituted alkenylene group, an alkynylene group and a substituted alkynylene group. The divalent aromatic group include an arylene group and a substituted arylene group. The combinations of the divalent aliphatic and aromatic groups include an aralkylene group and a substituted aralkylene group. An arylene group, a substituted arylene group, an aralkylene group and a substituted aralkylene group are preferred. An arylene group and a substituted arylene group are more preferred. An arylene group is further preferred. Phenylene is most preferred. Examples of the substituent groups for L include carboxyl and a halogen atom.

In the formula (I), A is an acidic nucleus. The acidic nucleus is a moiety corresponding to a compound that can release a proton. The acidic nucleus preferably is a five or six-membered nitrogen-containing heterocyclic ring. Examples of the heterocyclic rings include 5-pyrazolone ring, isoxazolone ring, barbituric acid ring, thiobarbituric acid ring, pyrazolopyridone ring, rhodanine ring, hydanloin ring, thiohydantoin ring, oxazolidinedione ring, pyrazolidinedione ring, indandione ring, hydroxypyridone ring, 1,2,3,4-tetrahydroquinoline-2,4-dione ring and 3-oxo-2,3,-dihyclrobenzo[d]thiophene-1,1-dioxide ring. Preferred are 5-pyrazolone ring, hydroxypyridone ring, pyrazolopyridone ring and barbituric acid ring. Particularly preferred is 5-pyrazolone ring.

In the formula (I), $R^1$ is hydrogen, an aliphatic group, an aromatic group, an alkoxycarbonyl group, an aryloxycarbonyl group, an alkoxy group, an aryloxy group, an acyloxy group, a sulfonyloxy group, a carbamoyloxy group, a carbamoyl group, a halogen atom (e.g., fluorine, chlorine, bromine), hydroxyl or carboxyl. Hydrogen, an aliphatic group, an aromatic group, an alkoxycarbonyl group and an aryloxycarbonyl group are preferred.

In the formula (I), $R^2$ is an aliphatic group, an aromatic group, an acyl group, a sulfonyl group, an alkoxycarbonyl group, an aryloxycarbonyl group, an alkoxy group, an aryloxy group, an acyloxy group, a sulfonyloxy group, a carbamoyloxy group, amino, a substituted amino group, a heterocyclic group, an amido group, a carbamoyl group, a sulfonamido group, a halogen atom, hydroxyl, nitro, cyano or carboxyl. An aliphatic group, an aromatic group, an alkoxy group, an acyloxy group, amino, a substituted amino group, a heterocyclic group, an amido group, a carbamoyl group, a halogen atom (e.g., fluorine, chlorine, bromine), nitro and carboxyl are preferred.

In the formula (I), $R^3$ is hydrogen, an aliphatic group, an aromatic group or a halogen atom (e.g., fluorine, chlorine, bromine). Hydrogen, an aliphatic group (preferably an alkyl group) and an aromatic group (preferably an aryl group) are preferred.

The aliphatic group for $R^1$, $R^2$ and $R^3$ include an alkyl group, a substituted alkyl group, an alkenyl group, a substituted alkenyl group, an alkynyl group, a substituted alkynyl group, an aralkyl group and a substituted aralkyl group. An alkyl group, a substituted alkyl group, an aralkyl group and a substituted aralkyl group are preferred.

The alkyl group and the substituted alkyl group preferably have 1 to 8 carbon atoms. Examples of the alkyl groups and the substituted alkyl groups include methyl, ethyl, propyl, isopropyl, n-butyl, isobutyl, sec-butyl, tert-butyl, cyclohexyl, methoxyethyl, ethoxyethyl, ethoxycarbonylmethyl, ethoxycarbonylethyl, cyanoethyl, diethylaminoethyl, hydroxyethyl, chloroethyl and acetoxyethyl.

The aralkyl group and the substituted aralkyl group preferably have 7 to 12 carbon atoms. Examples of the aralkyl groups and the substituted aralkyl groups include benzyl and 2-carboxybenzyl.

The aromatic group for $R^1$, R2 and $R^3$ include an aryl group and a substituted aryl group. The aromatic group preferably has 6 to 18 carbon atoms. Examples of the aromatic groups include phenyl, 4-methylphenyl, 4-methoxyphenyl, 4-carboxyphenyl and 3,5-dicarboxyphenyl.

The acyl group for $R^2$ preferably has 2 to 6 carbon atoms. Examples of the acryl groups include acetyl, propionyl, butanoyl and chloroacetyl.

The sulfonyl group for $R^2$ preferably has 1 to 8 carbon atoms. Examples of the sulfonyl groups include methanesulfonyl and p-toluenesulfonyl.

The alkoxycarbonyl group for $R^1$ and $R^2$ preferably has 2 to 6 carbon atoms. Examples of the alkoxycarbonyl groups include methoxycarbonyl and ethoxycarbonyl.

The aryloxycarbonyl group for $R^1$ and $R^2$ preferably has 7 to 12 carbon atoms. Examples of the aryloxycarbonyl groups include phenoxycarbonyl, 4-methylphenoxycarbonyl and 4-methoxycarbonyl.

The alkoxy group for $R^1$ and $R^2$ preferably has 1 to 4 carbon atoms. Examples of the alkoxy groups include methoxy, ethoxy, n-butoxy and methoxyethoxy.

The aryloxy group for $R^1$ and $R^2$ preferably has 6 to 10 carbon atoms. Examples of the aryloxy groups include phenoxy and 4-methoxyphenoxy.

The acyloxy group for $R^1$ and $R^2$ preferably has 2 to 8 carbon atoms. Examples of the acyloxy groups include acetoxy, ethylcarbonyloxy, cyclohexylcarbonyloxy, benzoyloxy and chloroacetyloxy.

The sulfonyloxy group for $R^1$ and $R^2$ preferably has 1 to 6 carbon atoms. An example of the sulfonyloxy group is methanesulfonyloxy.

The carbamoyloxy group for $R^1$ and $R^2$ preferably has 2 to 8 carbon atoms. Examples of the carbamoyloxy groups include methylcarbamoyloxy and diethylcarbaomyloxy.

The substituted amino group for $R^2$ preferably has 1 to 8 carbon atoms. Examples of the substituted amino groups include methylamino, dimethylamino, diethylamino, phenylamino, methoxyphenylamino, chlorophenylamino, pyridylamino, methoxycarbonylamino, n-butoxycarbonylamino, phenoxycarbonylamino, methylcarbamoylamino, phenylcarbamoylamino and methylsulfonylamino.

The heterocyclic group for $R^2$ preferably has 1 to 8 carbon atoms. Examples of the heterocyclic groups include morpholino, piperidino and pyrrolidino.

The amido group for $R^2$ preferably has 1 to 8 carbon atoms. Examples of the amido groups include acetamido, propionamido, cyclohexamido, benzamido and chloroacetamido.

The carbamoyl group for $R^1$ and $R^2$ preferably has 1 to 8 carbon atoms. Examples of the carbamoyl groups include carbamoyl, methylcarbamoyl, ethylcarbamoyl, n-butylcarbamoyl, t-butylcarbamoyl, dimethylcarbamoyl, morpholinocarbamoyl and pyrrolidinocarbamoyl.

The sulfonamido group for $R^2$ preferably has 1 to 8 carbon atoms. Examples of sulfonamido groups include methanesulfonamido and toluenesulfonamido.

In the formula (I), each of $R^4$, $R^5$ and $R^6$ independently is hydrogen, an alkyl group, cyano or a halogen atom (e.g., fluorine, chlorine, bromine). Hydrogen is particularly preferred.

In the formula (I), m is an integer of 0 to 4, preferably is 0, 1, 2, more preferably is 0 or 1, and most preferably is 0. When m is 2, 3 or 4, the groups represented by $R^2$ may be different from each other.

In the formula (I), n is 0 or 1, and preferably is 0.

In the formula (I), X is an electron attractive group having a Hammett's substituent constant ($\sigma_m$) of 0.3 to 1.5. The Hammett's substituent constant is described in Chem. Rev. 91, 165 (1991). X preferably is a halogen atom such as fluorine ($\sigma_m$32 0.34), chlorine (0.37), bromine (0.39), iodine (0.35); trifluoromethyl (0.43); cyano (0.56); formyl (0.35); an acyl group such as acetyl (0.38); an acyloxy group such as acetoxy (0.39); carboxyl (0.37); an alkoxycarbonyl group such as methoxycarbonyl (0.37); an aryloxycarbonyl group such as phenoxycarbonyl (0.37); an alkylcarbamoyl group such as methylcarbamoyl (0.35); nitro (0.71); an alkylsulfinyl group such as methylsulfinyl (0.52); an alkylsulfonyl group such as methylsulfonyl (0.60); or a sulfamoyl group (0.53). An alkoxycarbonyl group and cyano are preferred. An alkoxycarbonyl group is particularly preferred.

A preferred dye is represented by the formula (Ia).

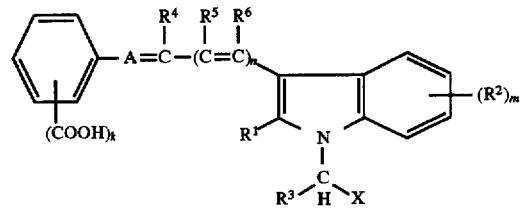

(Ia)

In the formula (Ia), A, $R^1$, $R^2$, $R^3$, $R^4$, $R^5$, $R^6$, m, n and X have the same meanings as those defined in the formula (I), and k is 1, 2 or 3, preferably is 1 or 2, and more preferably is 1.

Another preferred dye is represented by the formula (Ib).

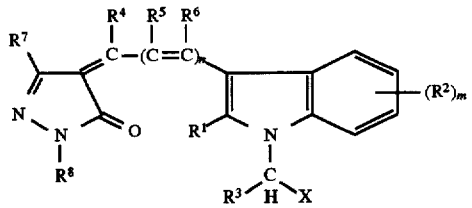

(Ib)

In the formula (Ib), $R^1$, $R^2$, $R^3$, $R^4$, $R^5$, $R^6$, m, n and X have the same meanings as those defined in the formula (I), at least one of $R^7$ and $R^8$ corresponds to HOOC—L—in the formula (I), and the other of $R^7$ and $R^8$ have the same meaning as $R^2$ in the formula (I).

A further preferred dye is represented by the formula (Ic).

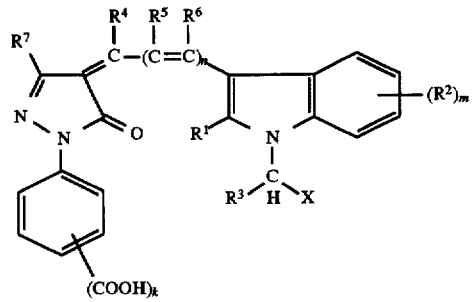

(Ic)

In the formula (Ic), $R^1$, $R^2$, $R^3$, $R^4$, $R^5$, $R^6$, m, n and X have the same meanings as those defined in the formula (I), $R^7$ has the same meaning as $R^2$ in the formula (I), and k is 1, 2 or 3, preferably is 1 or 2, and more preferably is 1.

The dye represented by the formula (I) is preferably insoluble in water, or has a solubility of not more than 1.0 g per 1 liter of water at 25° C.

Examples of the dyes are shown below.
(1)
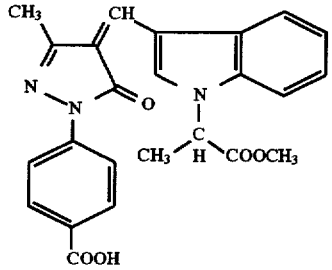
(2)
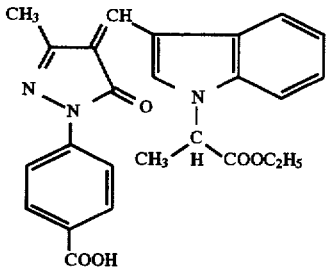
(3)
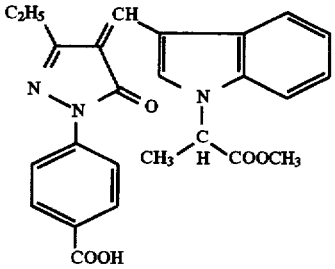
(4)
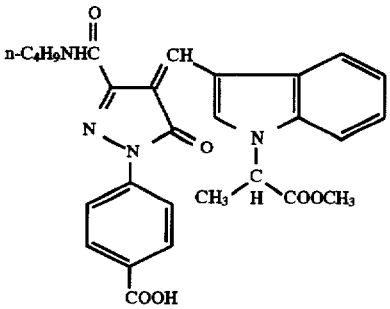
(5)
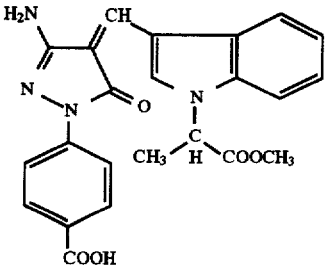
-continued
(6)
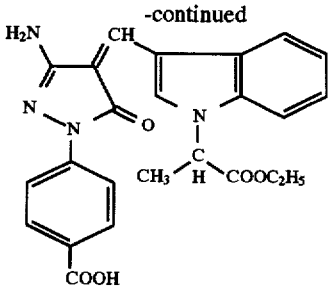
(7)
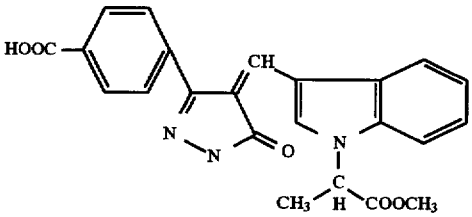
(8)
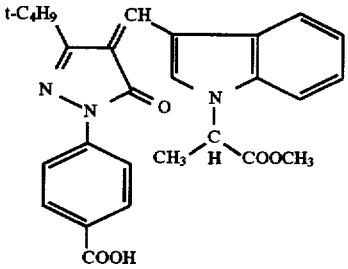
(9)
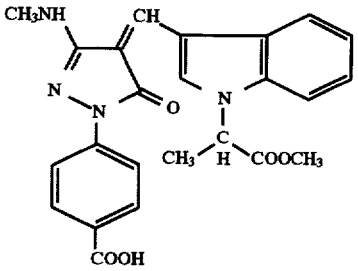
(10)
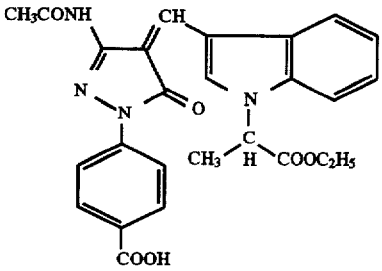
(11)
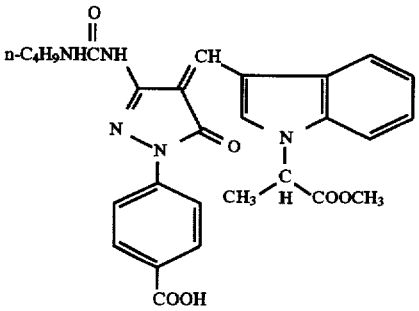

-continued
(12)
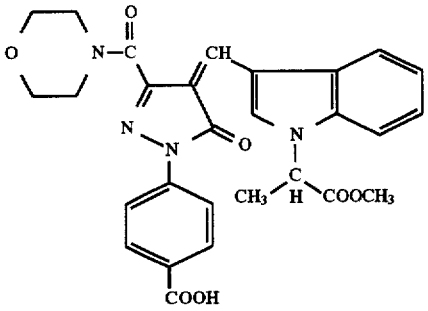
(13)
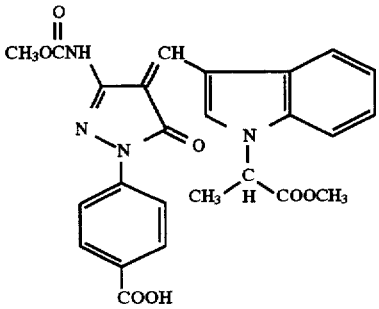
(14)
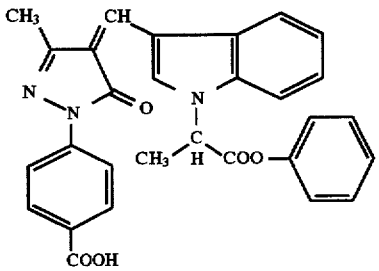
(15)
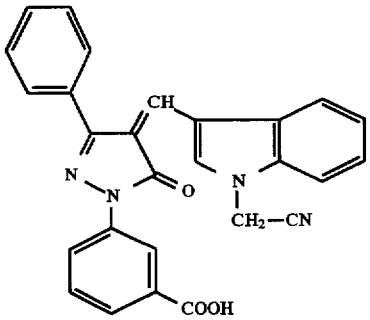
(16)
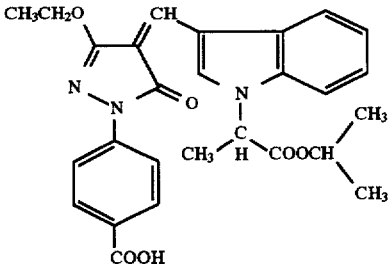
-continued
(17)
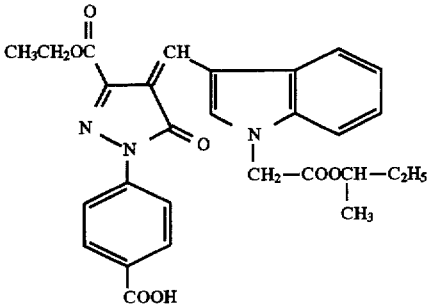
(18)
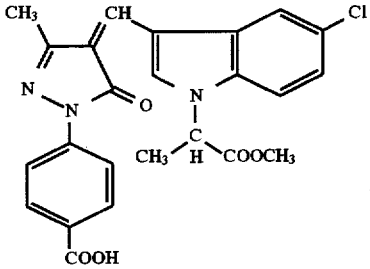
(19)
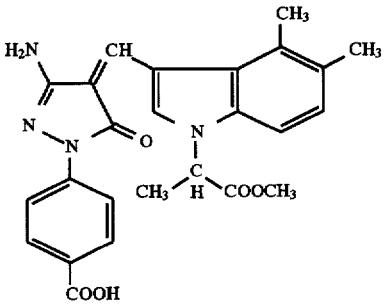
(20)
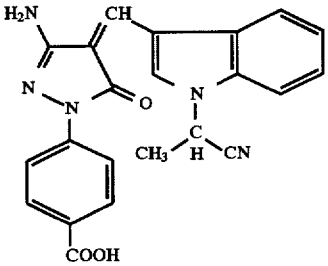
(21)
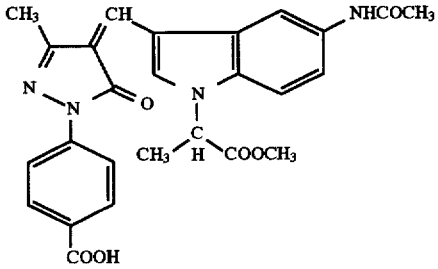

-continued
(22)
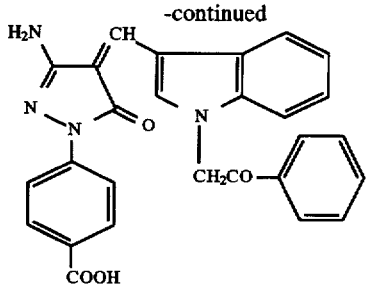
(23)
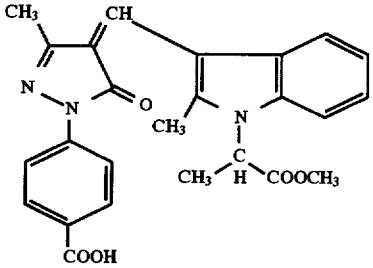
(24)
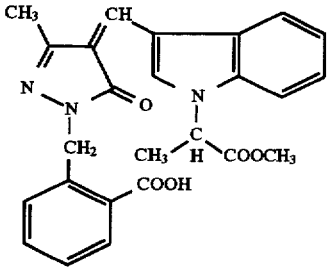
(25)
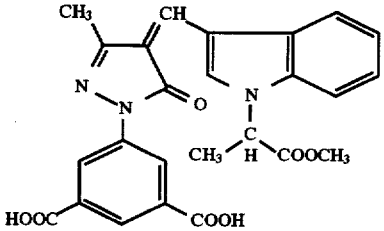
(26)
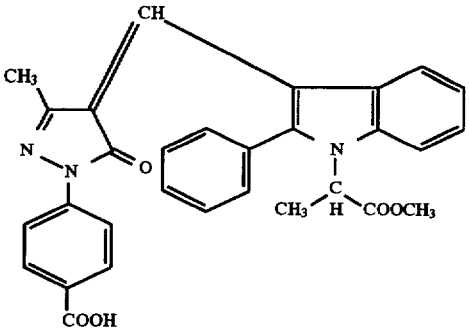
(27)
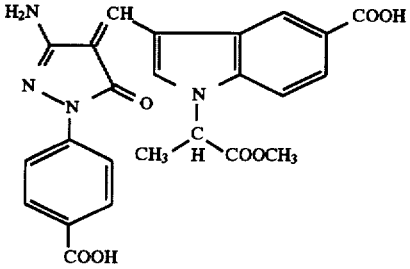
-continued
(28)
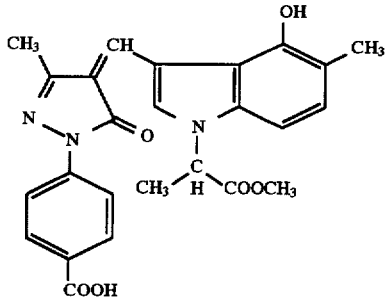
(29)
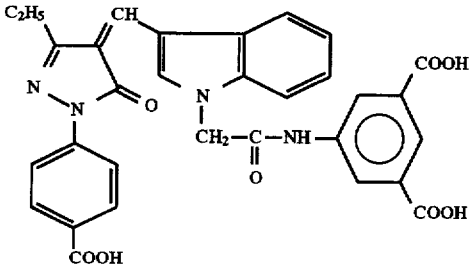
(30)
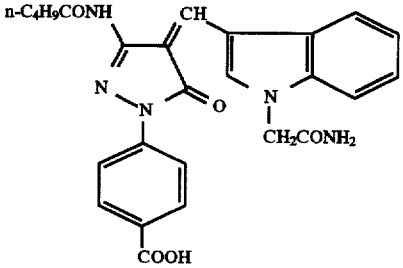
(31)
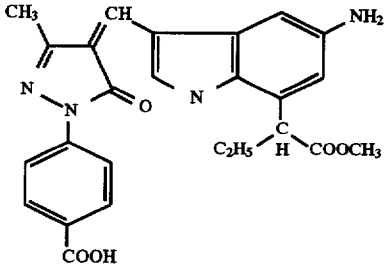
(32)
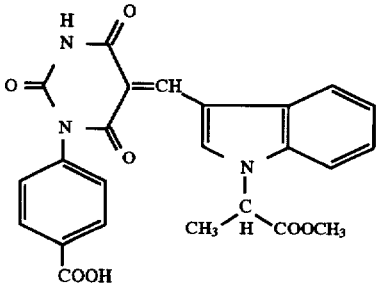

-continued
(33)
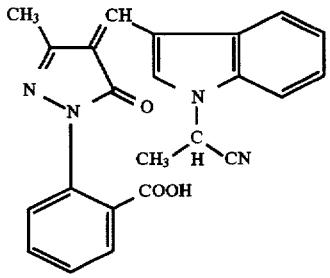
(34)
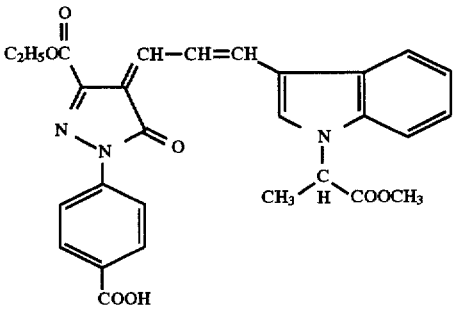
(35)
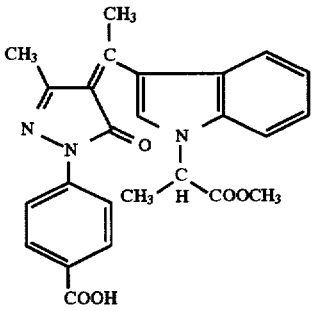
(36)
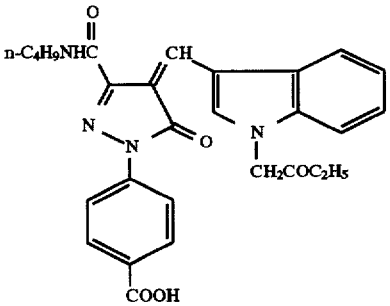
(37)
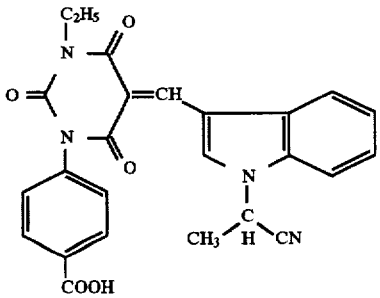
-continued
(38)
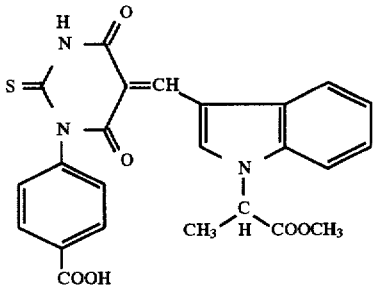
(39)
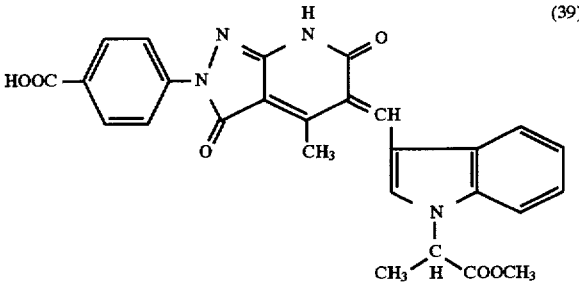
(40)
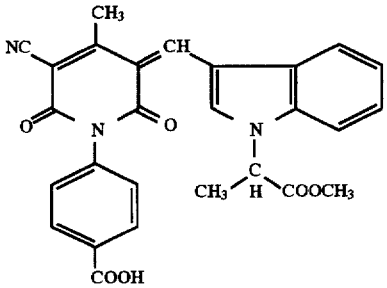
(41)
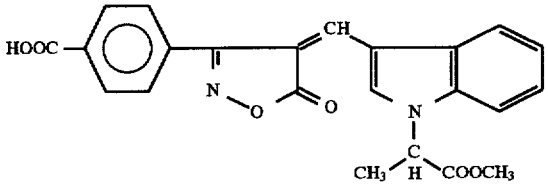
(42)
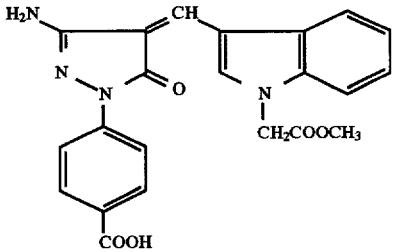
(43)
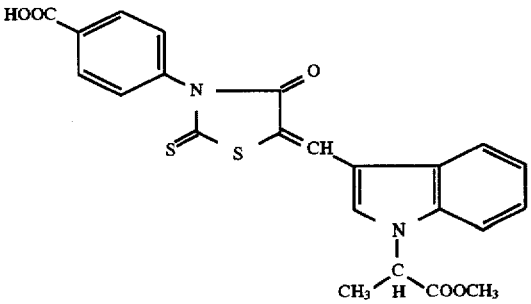

-continued (44)

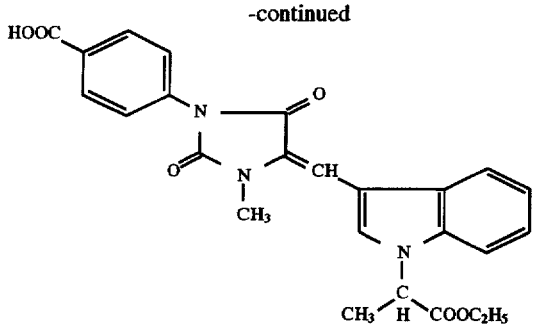

(45)

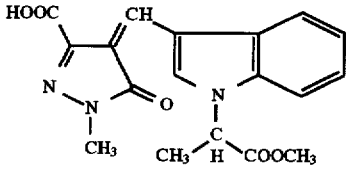

The dye of the present invention can be synthesized by a reaction of a compound of HOOC—L—A with a compound represented by the formula (II).

(II)

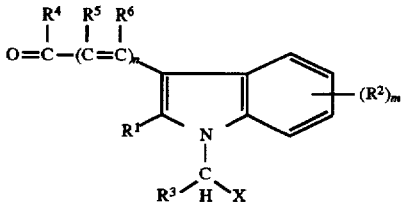

In the formula (II), $R^1$, $R^2$, $R^3$, $R^4$, $R^5$, $R^6$, m, n and X have the same meanings as those defined in the formula (I).

The reaction proceeds in an organic solvent at the room temperature or under refluxed conditions. Examples of the organic solvents include methanol, ethanol, isopropyl alcohol, acetonitrile, N,N-dimethylformamide, N,N-dimethylacetamide, acetic acid and pyridine.

If the rate of the reaction is slow, acetic acid, acetic anhydride, p-toluenesulfonic acid, trimethylamine, pyridine or ammonium acetate may be added to a reaction system to accelerate the reaction.

Synthesis examples are shown below.

Synthesis of methyl 2-(3-formyl-1-indolyl )propyonate

With 30 ml of N,N-dimethylformamide, 4.4 g of indole-3-carbaldehyde, 5.5 g of methyl 2-bromopropionate and 8.3 g of potassium carbonate were mixed. The mixture was stirred for 3 hours while heating in a steam bath. The reaction mixture was cooled to the room temperature. The mixture was poured into ice-cold water while stirring. An oily substance was precipitated, and then coagulated. The precipitation was recrystallized with ethanol to obtain 6.2 g of the subject compound in the form of crystals.

Synthesis of compound (1)

With 50 ml of N,N-dimethylacetamide, 5.5 g of 1-p-carboxyphenyl-3-methyl-5-pyrazolone and 5.8 g of methyl 2-(3-formyl-1-indolyl)propionate were mixed. The mixture was heated for 4 hours in a steam bath. The mixture was cooled to the room temperature. To the mixture, 50 ml of methanol was added. The resulting mixture was stirred at the same temperature. Crystals were filtered off, washed with a small amount of methanol, and dried to obtain 7.4 g of the compound (1). In dimethylformamide, λ max was 406 nm.

Synthesis of compound (5)

With 30 ml of N,N-dimethylformamide, 6.6 g of 3-amino-1-p-carboxyphenyl-5-pyrazolone and 6.9 g of methyl 2-(3-formyl-1-indolyl)propionate were mixed. The mixture was heated for 4 hours in a steam bath. The mixture was cooled to the room temperature. To the mixture, 30 ml of methanol was added. The resulting mixture was stirred at the same temperature. Crystals were filtered off, and washed with methanol to obtain 7.6 g of the compound (5). In dimethylformamide, λ max was 414 nm.

The dye is preferably in the form of solid particles that are dispersed in the silver halide emulsion layer or the hydrophilic colloidal layer.

The solid particle dispersion can be prepared by a conventional process. The conventional process is described in Japanese Patent Provisional Publication No. 52(1977)-92716 and International Patent Publication No. 88/04794. The conventional dispersing devices can be used. Examples of the conventional devices include ball mills, sand mills, colloid mills, vibration ball mills, planet ball mills, jet mills, roll mills, mantongaurins, microfluidizers and deskimpeller mills. Longitudinal or lateral dispersing devices can be used.

The medium for the dispersion preferably is water. A dispersing surface active agent is preferably added to the medium. An anionic, nonionic or cationic surface active agent can be used. An anionic surface active agent is preferred. Preferred anionic surface active agents are described in Japanese Patent Provisional Publication No. 52(1977)-92716 and International Patent Publication No. 88/04794. An anionic polymer can be used in place of the anionic surface active agents. The anionic polymer is described in Japanese Patent Application No. 3(1991)-121749.

The dispersion can also be formed by dissolving the dye in a solvent and adding a poor solvent to the solution to precipitate fine crystals of the dye. In this case, the above-mentioned dispersing surface active agents can also be used. Further, the dispersion can be formed by dissolving the dye in a solvent at a controlled pH and adjusting pH to precipitate the fine crystals.

The particles of the dye have an average diameter preferably in the range of 0.005 to 10 μm, more preferably in the range of 0.01 to 1 μm, further preferably in the range of 0.01 to 0.5 μm, and most preferably in the range of 0.01 to 0.1 μm. The particles preferably have a uniform particle size distribution.

The dye can be directly dispersed without pretreatment. A wetted dye just after synthesis is preferably used to form the dispersion.

If necessary, the dye can be heated before or after the dispersing procedures. The dye is heated preferably after the dispersing procedures.

The heating temperature is preferably in the range of 40° C. to the decomposition point of the dye, more preferably in the range of 40° to 250° C., and most preferably in the range of 50° to 150° C.

The heating time is preferably in the range of 15 minutes to 1 week, and more preferably in the range of 1 hour to 4 days.

The dye is heated preferably in a medium. The dye should be insoluble in the medium. Examples of the heating mediums include water, alcohols (e.g., methanol, ethanol, isopropyl alcohol, butanol, isoamyl alcohol, octanol, ethylene glycol, diethylene glycol, ethylcellosolve), ketones (e.g., acetone, methyl ethyl ketone), esters (e.g., ethyl acetate, butyl acetate), alkylcarboxylic acid (e.g., acetic acid, propionic acid), nitriles (e.g., acetonitrile), ethers (e.g., dimethoxyethane, dioxane, tetrahydrofuran).

The dye is heated preferably in the presence of a carboxylic acid. Examples of the carboxylic acids include alkylcarboxylic acids (e.g., acetic acid, propionic acid), carboxymethylcelluloses (CMC) and arylcarboxylic acids (e.g., benzoic acid, salicylic acid). The amount of the carboxylic acid is preferably in the range of 0.5 to 100 times based on the amount of the dye. In the case that the medium other than the carboxylic acid is used, the amount of the medium is preferably in the range of 0.05 to 100% based on the amount of the dye.

The dye can be used in various black and white or color photographic materials. A color photographic material has many layers and contains various additives including oily additives. Accordingly, it is difficult to bleach or remove a dye contained in the color photographic material rather than a dye in a black and white material. The dye of the present invention is particularly effective in the color photographic material.

The dye of the present invention is contained in the silver halide emulsion layer or the hydrophilic colloidal layer preferably in an amount of 0.5 to 1,000 mg/m$^2$, and more preferably in an amount of 1 to 500 mg/m$^2$. The amount is preferably so adjusted that the optical density is in the range of 0.05 to 3.0.

The dye is preferably added to a non-light-sensitive hydrophilic colloidal layer. Examples of the hydrophilic colloidal layers include an intermediate layer, a protective layer, an antihalation layer, a filter layer and a backing layer. The dye can be added to two or more layers.

The dye is preferably used as a yellow filter dye, which is contained in a yellow filter layer. A yellow filter layer is usually provided between a blue sensitive emulsion layer and green and red sensitive emulsion layers. In this case, a silver halide photographic material comprises a support, a red sensitive emulsion layer, a green sensitive emulsion layer, a yellow filter layer and a blue sensitive emulsion layer in the order.

The silver halide photographic material may contain a dye other than the dye of the present invention. Examples of the other dyes include oxonol dyes, hemioxonol dyes, styryl dyes, merocyanine dyes, anthraquinone dyes and azo dyes. Further, cyanine dyes, azomethine dyes, triarylmethane dyes and phthalocyanine dyes can be used. A water soluble dye can be used in the form of an aqueous solution. A water insoluble dye can be used in the form of a solid particle dispersion. An oily solution of an oil soluble dye can be emulsified in water to add the dye to a hydrophilic colloidal layer.

The other additives for black and white silver halide photographic materials are described in Japanese Patent Provisional Publication No. 6(1994)-317879 (on page 33, right column, line 33 to page 35, line 43). Spectral sensitizing dyes for black and white photographic materials are described in Japanese Patent Provisional Publications No. 2(1990)-12236 (on page 8, left lower column, line 13 to right lower column, line 4), No. 2(1990)-103536 (on page 16, right lower column, line 3 to page 17, left lower column, line 20), No. 1(1989)-112235, No. 2(1990)-124560, No. 3(1991)-7928, No. 4(1992)-330434 and No. 5(1993)-11389. Nucleation accelerating agents for black and while photographic materials are described in Japanese Patent Provisional Publications No. 6(1994)-82943 (formulas (I) to (VI)), No. 2(1990)-103536 (formulas (II-m) & (II-p) and compounds II-1 & II-2 on page 9, right upper column, line 13 to page 16, left upper column, line 10) and No. 1(1989)-179939. Dyes for black and white photographic materials are described in Japanese Patent Provisional Publications No. 2(1990)-103536 (on page 17, right lower column, lines 1 to 18), No. 2(1990)-39042 (on page 4, right upper column, line 1 to page 6, right upper column, line 5), No. 2(1990)-294638 and No. 5(1993)-11382.

The black and white photographic material can be processed according to conventional methods. The processes for the black and white photographic materials are described in Japanese Patent Provisional Publications No. 2(1990)-103037 (on page 16, right upper column, line 7 to page 19, left lower column, line 15), No. 2(1990)-115837 (on page 3, right lower column, line 5 to page 6, right upper column, line 10) and No. 2(1990)-55349 (on page 13, right lower column, line 1 to page 16, left upper column, line 10).

The additives and processes for a color photographic materials are described in Japanese Patent Provisional Publication No. 6(1994)-118563 (on pages 16 to 23).

The photographic material may contain a compound that can react with formaldehyde to fix it. Such a compound is described in U.S. Pat. No. 4,414,309.

The color photographic material can contain a yellow coupler (described in U.S. Pat. No. 5,118,599, European Patents No. 447,969A and No. 482,552A), a magenta coupler (described in U.S. Pat. No. 4,595,650, No. 5,250,400, International Patent Publication No. 92/18901, No. 92/18902, No. 92/18903, No. 93/02392), a pyrroloazole cyan coupler (described in European Patents No. 484,909A, No. 491,197, No. 545,300A and U.S. Pat. No. 5,164,289), an imidazotriazole cyan coupler (described in European Patent No. 556,777A), a five or six condensed ring cyan coupler (described in European Patent No. 556,700A) and a pyrrole cyan coupler (described in European Patent No. 488,109A).

Further, a color photographic material can contain a DIR coupler, which release a development inhibitor by a coupling reaction. The DIR couplers are described in U.S. Pat. Nos. 5,250,398, No. 5,250,399, European Patents No. 520,496A, No. 522,371A and No. 525,396A.

The silver halide photographic material is exposed to light by conventional exposing devices. The exposing methods are described in Japanese Patent Provisional Publication No. 3(1991)-238447 (on page 21, right lower column, line 16 to page 22, left upper column, line 13).

EXAMPLE 1

Preparation of sample No. 101

An undercoating layer was provided on a cellulose triacetate film having the thickness of 127 μm to prepare a support. The following coating solutions were coated on the undercoating layer to prepare a multi-layered color photographic material (sample No. 101). In the following layers, the amount is the coating amount per 1 m$^2$. The effects of the compounds are not limited to the titles of the compounds.

Twentieth layer (third protective layer)

| | |
|---|---|
| Gelatin | 0.40 g |
| Polymethyl methacrylate particles (average particle size: 1.5 μm) | 0.10 g |
| Methyl methacrylate/acrylic acid copolymer particles (copolymerization ratio: 4/6, average particle size: 1.5 μm) | 0.10 g |
| Silicone oil | 0.030 g |
| Surface active agent W-1 | 3.0 mg |
| Surface active agent W-2 | 0.030 g |

Nineteenth layer (second protective layer)

| | | |
|---|---|---|
| Colloidal silver | (amount of silver) | 0.10 g |
| Fine grain silver iodobromide emulsion (average grain size: 0.06 μm, AgI content: 1 mol %) | (amount of silver) | 0.10 g |
| Gelatin | | 0.40 g |

Eighteenth layer (first protective layer)

| | |
|---|---|
| Gelatin | 0.70 g |
| Ultraviolet absorbing agent U-1 | 0.20 g |
| Ultraviolet absorbing agent U-2 | 0.050 g |
| Ultraviolet absorbing agent U-3 | 0.30 g |
| Formalin scavenger Cpd-H | 0.40 g |
| Dye D-1 | 0.15 g |
| Dye D-2 | 0.050 g |
| Dye D-3 | 0.10 g |

Seventeenth layer (high blue sensitive emulsion layer)

| | | |
|---|---|---|
| Emulsion N | (amount of silver) | 0.20 g |
| Emulsion O | (amount of silver) | 0.20 g |
| Gelatin | | 1.20 g |
| Coupler C-5 | | 0.10 g |
| Coupler C-6 | | 0.10 g |
| Coupler C-10 | | 0.60 g |
| Tricresyl phosphate (high boiling organic solvent, Oil-2) | | 0.10 g |

Sixteenth layer (Middle blue sensitive emulsion layer)

| | | |
|---|---|---|
| Emulsion L | (amount of silver) | 0.30 g |
| Emulsion M | (amount of silver) | 0.30 g |
| Gelatin | | 0.90 g |
| Coupler C-5 | | 0.10 g |
| Coupler C-6 | | 0.10 g |
| Coupler C-10 | | 0.60 g |

Fifteenth layer (low blue sensitive emulsion layer)

| | | |
|---|---|---|
| Emulsion J | (amount of silver) | 0.20 g |
| Emulsion K | (amount of silver) | 0.30 g |
| Gelatin | | 0.80 g |
| Coupler C-5 | | 0.20 g |
| Coupler C-6 | | 0.10 g |
| Coupler C-10 | | 0.40 g |

Fourteenth layer (intermediate layer)

| | |
|---|---|
| Gelatin | 0.60 g |

Thirteenth layer (yellow filter layer)

| | | |
|---|---|---|
| Yellow colloidal silver | (amount of silver) | 0.090 g |
| Gelatin | | 1.10 g |
| Color stain inhibitor Cpd-A | | 0.010 g |
| Compound Cpd-L | | 0.010 g |
| Dibutyl phthalate (high boiling organic solvent, Oil-1) | | 0.010 g |

Twelfth layer (intermediate layer)

| | |
|---|---|
| Gelatin | 0.60 g |
| Compound Cpd-L | 0.050 g |
| Dibutyl phthalate (high boiling organic solvent, Oil-1) | 0.050 g |

Eleventh layer (high green sensitive emulsion layer)

| | | |
|---|---|---|
| Emulsion I | (amount of silver) | 0.50 g |
| Gelatin | | 1.00 g |
| Coupler C-4 | | 0.30 g |
| Coupler C-7 | | 0.10 g |
| Coupler C-8 | | 0.10 g |
| Compound Cpd-B | | 0.080 g |
| Compound Cpd-E | | 0.020 g |
| Compound Cpd-F | | 0.040 g |
| Compound Cpd-K | | 5.0 mg |
| Compound Cpd-L | | 0.020 g |
| Dibutyl phthalate (high boiling organic solvent, Oil-1) | | 0.020 g |
| Tricresyl phosphate (high boiling organic solvent, Oil-2) | | 0.020 g |

Tenth layer (middle green sensitive emulsion layer)

| | | |
|---|---|---|
| Emulsion G | (amount of silver) | 0.30 g |
| Emulsion H | (amount of silver) | 0.10 g |
| Gelatin | | 0.60 g |
| Coupler C-4 | | 0.10 g |
| Coupler C-7 | | 0.20 g |
| Coupler C-8 | | 0.10 g |
| Compound Cpd-B | | 0.030 g |
| Compound Cpd-D | | 0.020 g |
| Compound Cpd-E | | 0.020 g |
| Compound Cpd-F | | 0.050 g |
| Compound Cpd-L | | 0.050 g |
| Tricresyl phosphate (high boiling organic solvent, Oil-2) | | 0.010 g |

Ninth layer (low green sensitive emulsion layer)

| | | |
|---|---|---|
| Emulsion E | (amount of silver) | 0.10 g |
| Emulsion F | (amount of silver) | 0.20 g |
| Emulsion G | (amount of silver) | 0.20 g |
| Gelatin | | 0.50 g |
| Coupler C-4 | | 0.10 g |
| Coupler C-7 | | 0.050 g |
| Coupler C-8 | | 0.20 g |
| Compound Cpd-B | | 0.030 g |
| Compound Cpd-D | | 0.020 g |
| Compound Cpd-E | | 0.020 g |
| Compound Cpd-F | | 0.040 g |
| Compound Cpd-J | | 10 mg |
| Compound Cpd-L | | 0.020 g |
| Dibutyl phthalate (high boiling organic solvent, Oil-1) | | 0.10 g |
| Tricresyl phosphate (high boiling organic solvent, Oil-2) | | 0.10 g |

Eighth layer (intermediate layer)

| | | |
|---|---|---|
| Internally and externally fogged silver iodobromide emulsion (average grain size: 0.06 μm, distribution of coefficient: 16%, AgI content: 0.3 mol %) | (amount of silver) | 0.020 g |
| Yellow colloidal silver | (amount of silver) | 0.020 g |
| Gelatin | | 1.00 g |
| Additive P-1 | | 0.20 g |
| Color stain inhibitor Cpd-A | | 0.10 g |
| Compound Cpd-C | | 0.10 g |

Seventh layer (intermediate layer)

| | |
|---|---|
| Gelatin | 0.60 g |
| Additive M-1 | 0.30 g |
| Color stain inhibitor Cpd-1 | 2.6 mg |
| Dye D-5 | 0.020 g |
| Dye D-6 | 0.010 g |
| Compound Cpd-J | 5.0 mg |
| Dibutyl phthalate (high boiling organic solvent, Oil-1) | 0.020 g |

Sixth layer (high red sensitive emulsion layer)

| | | |
|---|---|---|
| Emulsion D | (amount of silver) | 0.40 g |
| Gelatin | | 1.10 g |
| Coupler C-1 | | 0.30 g |
| Coupler C-2 | | 0.10 g |
| Coupler C-3 | | 0.70 g |
| Additive P-1 | | 0.10 g |

Fifth layer (middle red sensitive emulsion layer)

| | | |
|---|---|---|
| Emulsion B | (amount of silver) | 0.20 g |
| Emulsion C | (amount of silver) | 0.30 g |
| Gelatin | | 0.80 g |
| Coupler C-1 | | 0.20 g |
| Coupler C-2 | | 0.050 g |
| Coupler C-3 | | 0.20 g |
| Tricresyl phosphate (high boiling organic solvent, Oil-2) | | 0.10 g |
| Additive P-1 | | 0.10 g |

Fourth layer (low red sensitive emulsion layer)

| | | |
|---|---|---|
| Emulsion A | (amount of silver) | 0.30 g |
| Emulsion B | (amount of silver) | 0.20 g |
| Gelatin | | 0.80 g |
| Coupler C-1 | | 0.15 g |
| Coupler C-2 | | 0.050 g |
| Coupler C-3 | | 0.050 g |
| Coupler C-9 | | 0.050 g |
| Compound Cpd-C | | 5.0 mg |
| Compound Cpd-J | | 5.0 mg |
| Tricresyl phosphate (high boiling organic solvent, Oil-2) | | 0.10 g |
| Additive P-1 | | 0.10 g |

Third layer (intermediate layer)

| | | |
|---|---|---|
| Internally and externally fogged silver iodobromide emulsion (average grain size: 0.06 μm, distribution of coefficient: 18%, AgI content: 1 mol %) | (amount of silver) | 0.050 g |
| Yellow colloidal silver | (amount of silver) | 0.030 g |
| Gelatin | | 0.40 g |

Second layer (intermediate layer)

| | |
|---|---|
| Gelatin | 0.40 g |
| Compound Cpd-C | 5.0 mg |
| Compound Cpd-J | 5.0 mg |
| Compound Cpd-K | 3.0 mg |
| High boiling organic solvent Oil-3 | 0.10 g |
| Dye D-4 | 0.80 mg |

First layer (antihalation layer)

| | |
|---|---|
| Black colloidal silver | 0.20 g |
| Gelatin | 1.90 g |
| Ultraviolet absorbing agent U-1 | 0.10 g |
| Ultraviolet absorbing agent U-3 | 0.040 g |
| Ultraviolet absorbing agent U-4 | 0.10 g |
| Dibutyl phthalate (high boiling organic solvent, Oil-1) | 0.10 g |
| Solid dispersion of fine crystals of dye E-1 | 0.10 g |

The additives for the layers are shown below.

C-1

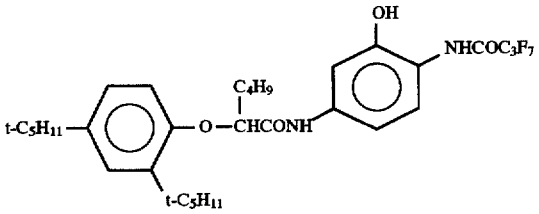

C-2

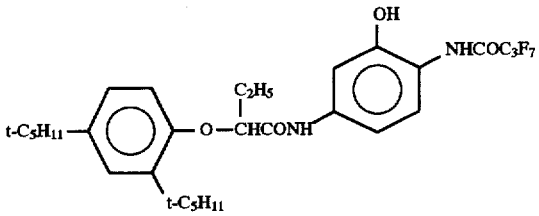

C-3

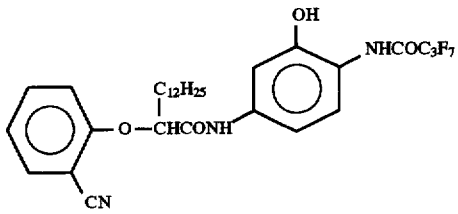

C-4

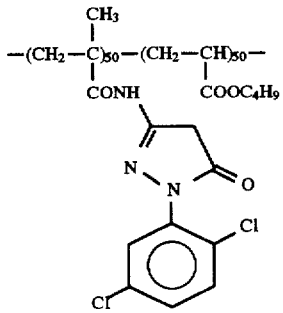

(Number: weight %. Average molecular weight: about 25,000)

C-5
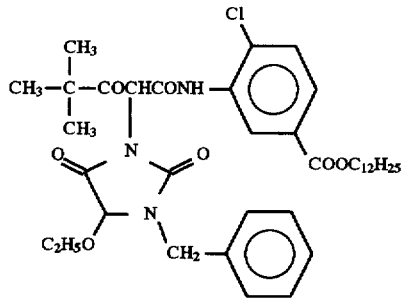
C-6
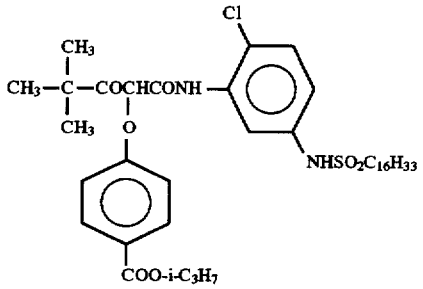
C-7
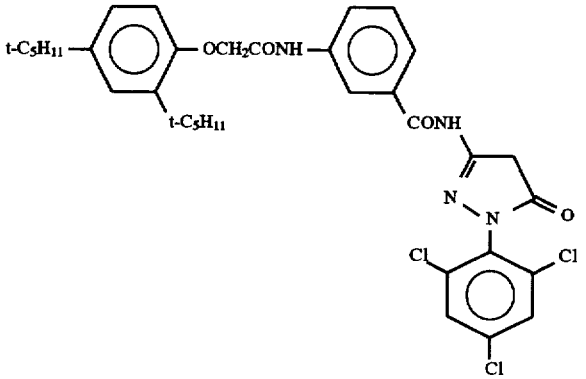
C-8
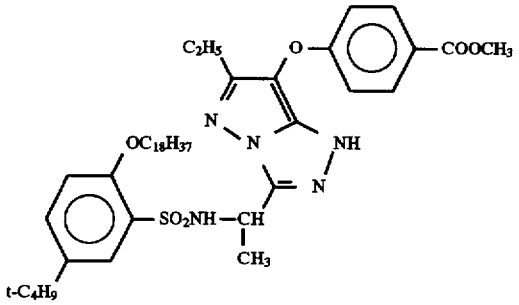
C-9
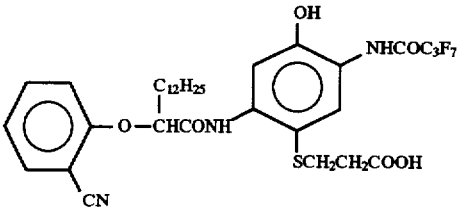

-continued
C-10
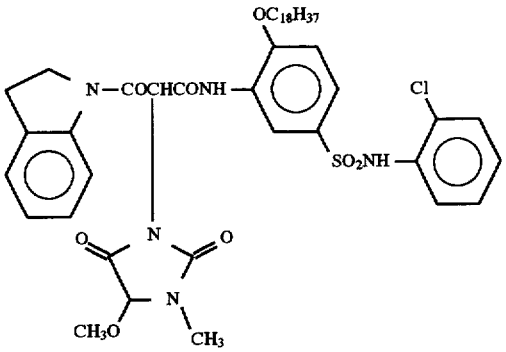
Oil-3
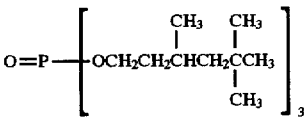
Cpd-A
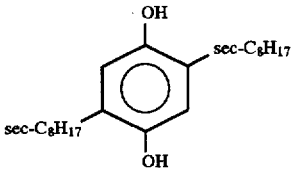
Cpd-B
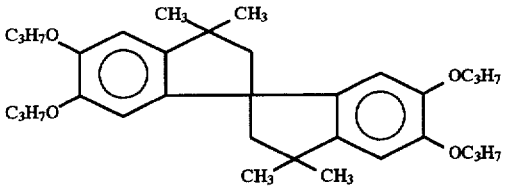
Cpd-C
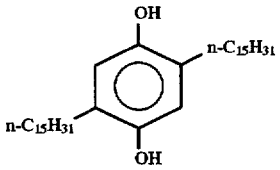
Cpd-D
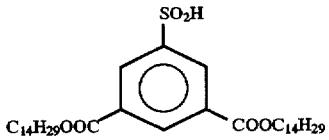
Cpd-E
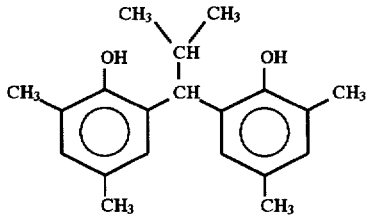
Cpd-F
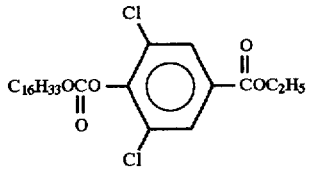

-continued
Cpd-H
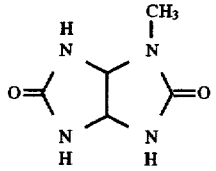
Cpd-I
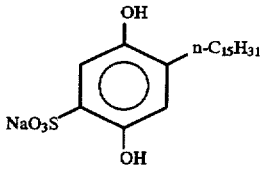
Cpd-J
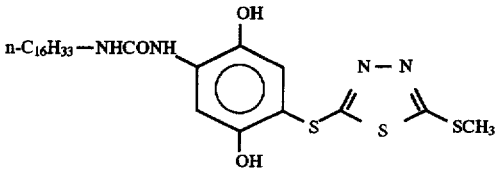
Cpd-K
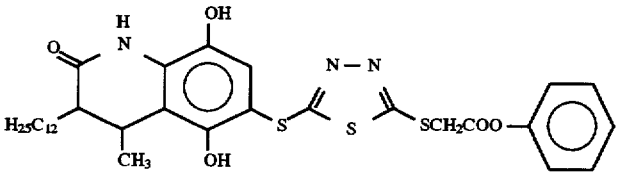
Cpd-L
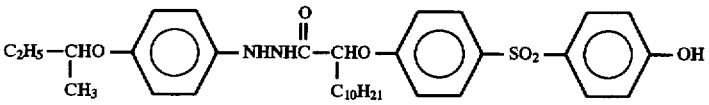
U-1
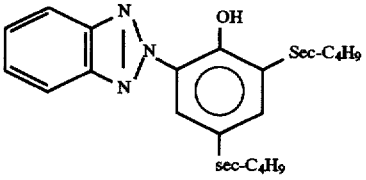
U-2
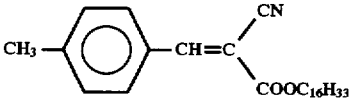
U-3
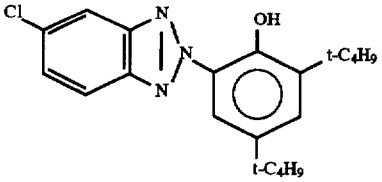
U-4
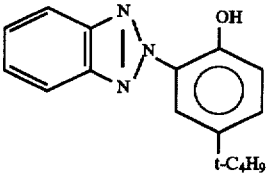
U-5
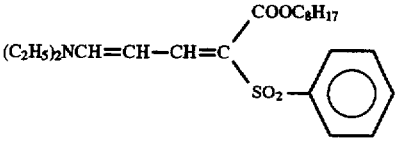

-continued
D-1
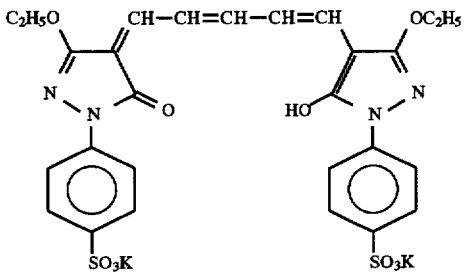
D-2
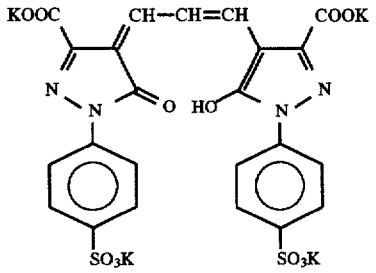
D-3
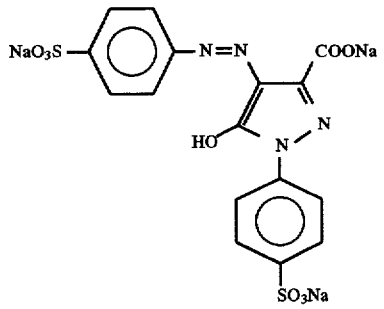
D-4
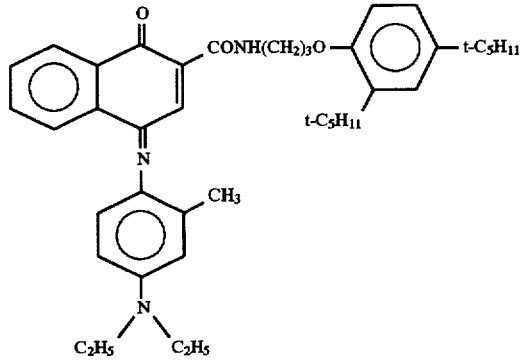
D-5
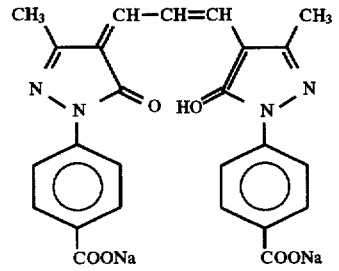

-continued

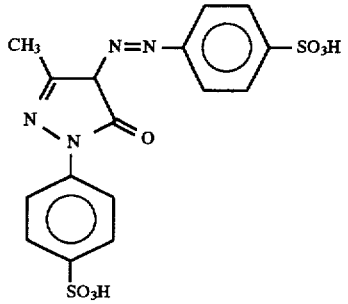

D-6

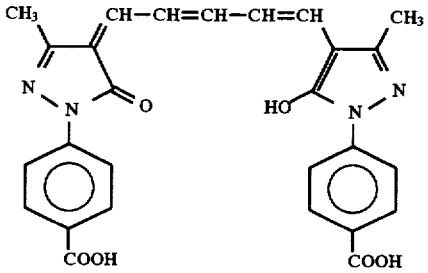

E-1

$C_8F_{17}SO_2NHCH_2CH_2CH_2OCH_2CH_2\overset{\oplus}{N}(CH_3)_3$

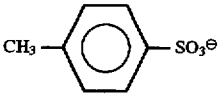

W-1

$C_8F_{17}SO_2N(C_3H_7)CH_2COOK$

W-2

$-(CH_2-CH(CONH-t\text{-}C_4H_9))_n-$

P-1

$-(CH_2-CH(COOC_4H_9))_n-$

M-1

The following emulsions A to O were used.

A: Monodispersed tetradecahedral emulsion
B: Monodispersed cubic internal latent image emulsion
C: Monodispersed cubic emulsion
D: Monodispersed tabular emulsion (aspect ratio: 3.0)
E: Monodispersed cubic emulsion
F: Monodispersed tetradecahedral emulsion
G: Monodispersed cubic internal latent image emulsion
H: Monodispersed cubic emulsion
I: Monodispersed tabular emulsion (aspect ratio: 5.0)
J: Monodispersed cubic emulsion
K: Monodispersed tetradecahedral emulsion
L: Monodispersed tabular emulsion (aspect ratio: 5.0)
M: Monodispersed tabular emulsion (aspect ratio: 8.0)
N: Monodispersed tabular emulsion (aspect ratio: 6.0)
O: Monodispersed tabular emulsion (aspect ratio: 9.0)

The other characteristics of the emulsions are shown in Tables 1 (red sensitive emulsions), 2 (green sensitive emulsions) and 3 (blue sensitive emulsions). In the Tables, the grain size means the average diameter (μm) of the spheres corresponding to the grains, σ means the distribution coefficient of the grain size, AgI means the silver iodide content in the halide composition of the grains, and the sensitizing dyes mean the amounts (g) based on 1 mol of silver halide.

TABLE 1

| Emulsion | Grain size | σ | AgI | Sensitizing dyes S-1 | S-2 | S-3 | S-8 |
|---|---|---|---|---|---|---|---|
| A | 0.28 | 16% | 4.0% | — | 0.025 | 0.25 | 0.010 |
| B | 0.30 | 10% | 4.0% | 0.010 | — | 0.25 | 0.010 |
| C | 0.38 | 10% | 5.0% | 0.010 | 0.010 | 0.25 | 0.010 |
| D | 0.68 | 8% | 2.0% | — | 0.010 | 0.10 | 0.010 |

TABLE 2

| Emulsion | Grain size | σ | AgI | Sensitizing dyes S-4 | S-5 | S-9 |
|---|---|---|---|---|---|---|
| E | 0.20 | 17% | 4.0% | 0.50 | 0.10 | — |
| F | 0.25 | 16% | 4.0% | 0.30 | 0.10 | — |
| G | 0.40 | 11% | 4.0% | 0.25 | 0.08 | 0.05 |
| H | 0.50 | 9% | 3.5% | 0.20 | 0.060 | 0.050 |
| I | 0.80 | 10% | 2.0% | 0.30 | 0.070 | 0.10 |

TABLE 3

| Emulsion | Grain size | σ | AgI | Sensitizing dyes S-6 | Sensitizing dyes S-7 |
|---|---|---|---|---|---|
| J | 0.30 | 18% | 4.0% | 0.050 | 0.20 |
| K | 0.45 | 17% | 4.0% | 0.05 | 0.20 |
| L | 0.55 | 10% | 2.0% | 0.060 | 0.22 |
| M | 0.70 | 13% | 2.0% | 0.050 | 0.17 |
| N | 1.00 | 10% | 1.5% | 0.040 | 0.15 |
| O | 1.20 | 15% | 1.5% | 0.060 | 0.22 |

The sensitizing dyes S-1 to S-9 are shown below.

S-1

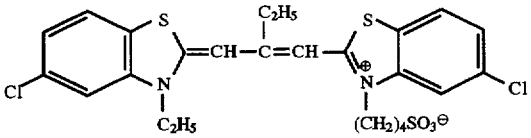

S-2

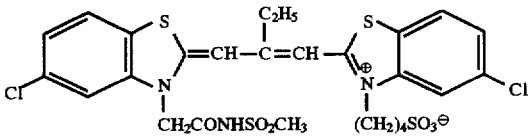

S-3

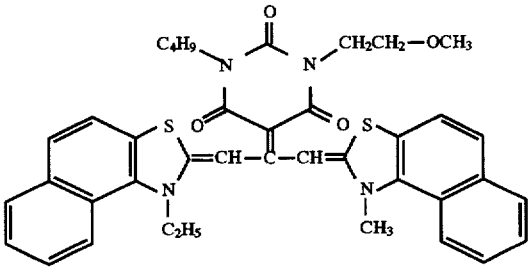

S-4

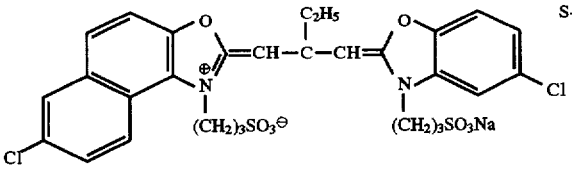

S-5

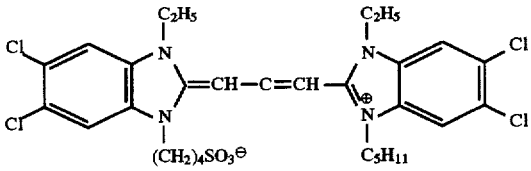

S-6

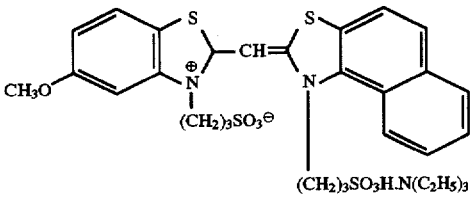

-continued

S-7

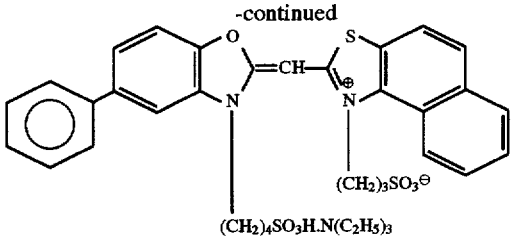

S-8

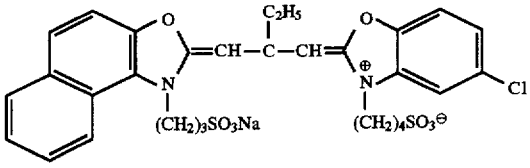

S-9

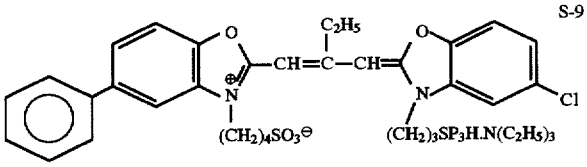

Further, the additives F-1 to F-8 were added to each of the emulsion layers. Furthermore, a gelatin hardening agent H-1 and the coating or emulsifying surface active agents W-3, W-4, W-5 and W-6 were added to each of the layers.

Moreover, phenol, 1,2-benzisothiazoline-3-one, 2-phenoxyethanol, phenethyl alcohol and butyl p-benzoate (antiseptics) were added to the layers.

H-1

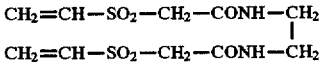

W-3

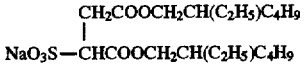

W-4

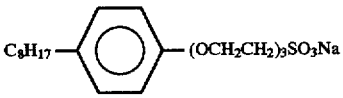

W-5

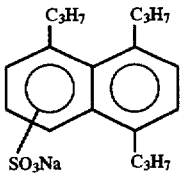

W-6

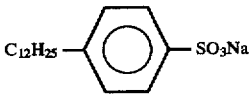

F-1

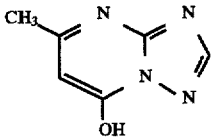

F-2

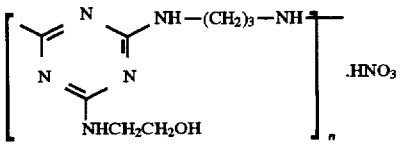

(n = 3–4)

-continued

F-3

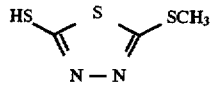

F-4

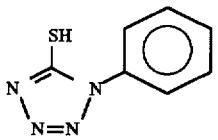

F-5

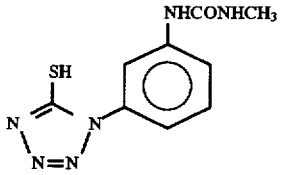

F-6

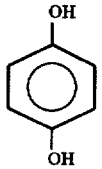

F-7

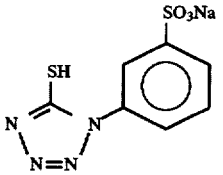

F-8

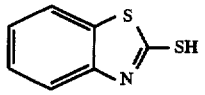

Preparation of solid particle dispersions A to H

In a pot, 10 g of the following comparative dye (a), 2 g of a surface active agent (Demol T, Kao Co., Ltd.), 241 g of water ad 400 cc of zirconium oxide beads were placed. The mixture was dispersed for 4 days in a stirring ball mill (Chuo Koki Co., Ltd.). The contents was filtered to remove the beads. Gelatin was added to the remaining contents to obtain a solid particle dispersion A.

Solid particle dispersions B to H were prepared in the same manner as in the preparation of the dispersion A, except that the comparative dyes (b), (c), (d), (e) and the dyes of the present invention 1, 5 and 30 were used in place of the comparative dye (a). The amounts of the dyes were the same as the amount (10 g) of the dye (a).

Comparative dye (a)

(Compound 7 disclosed in Japanese Patent Provisional Publication No. 3(1991)-167546)

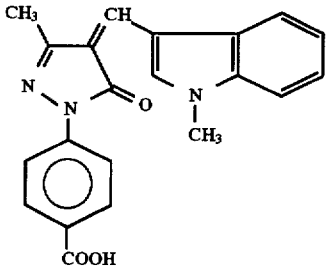

Comparative dye (b)

(Formula 101 disclosed in Japanese Patent Provisional Publication No. 55 (1980) -155351)

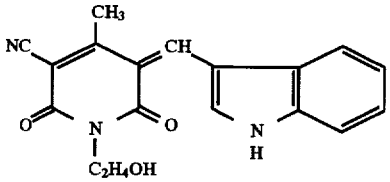

Comparative dye (c)

(Compound 66 disclosed in Japanese Patent Provisional Publication No. 3 (1991)-144438

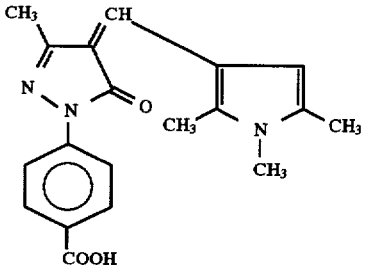

Comparative dye (d)

(Dye 1 disclosed in U.S. Pat. No. 4,923,788)

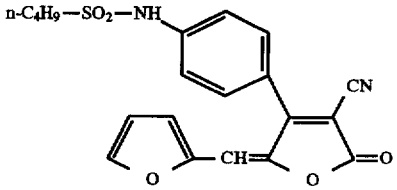

Comparative dye (e)

(Compound 22 disclosed in Japanese Patent Provisional Publication No. 5 (1993)-86056)

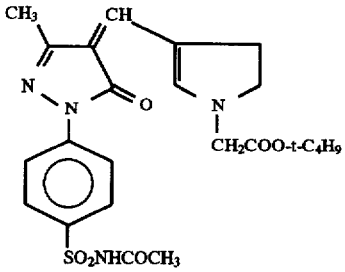

Preparation of samples No. 102 to No. 109

Sample No. 102 was prepared in the same manner as in the preparation of the sample No. 101, except that the solid particle dispersion A was added to the thirteenth layer in place of the yellow colloidal silver. The amount of the comparative dye (a) was $0.78\times10^{-3}$ mol per $m^2$.

Samples Nos. 103 to 109 was prepared in the same manner as in the preparation of the sample No. 102, except that the same amounts of the solid particle dispersions B to H were respectively used.

Development of samples

The samples were imagewise exposed to white light. The samples were then processed according to the following 20 conditions.

| Processing | Time | Temp. | Tank | Replenish |
|---|---|---|---|---|
| First development | 6 minutes | 38° C. | 12 l | 2,200 ml/m² |
| First washing | 2 minutes | 38° C. | 4 l | 7,500 ml/m² |
| Reversal | 2 minutes | 38° C. | 4 l | 1,100 ml/m² |
| Color development | 6 minutes | 38° C. | 12 l | 2,200 ml/m² |
| Pre-bleaching | 2 minutes | 38° C. | 4 l | 1,100 ml/m² |
| Bleaching | 6 minutes | 38° C. | 12 l | 220 ml/m² |
| Fixing | 4 minutes | 38° C. | 8 l | 1,100 ml/m² |
| Second washing | 4 minutes | 38° C. | 8 l | 7,500 ml/m² |
| Final rinsing | 1 minute | 25° C. | 2 l | 1,100 ml/m² |

(Remark)
Replenish: Amount of the replenisher
Tank: Content of the tank

The compositions for the processing solutions are shown below.

| | Tank | Replenisher |
|---|---|---|
| First developing solution | | |
| Pentasodium nitrilo-N,N,N-trimethylenephosphonic acid | 1.5 g | 1.5 g |
| Pentasodium diethylenetriaminetetracetic acid | 2.0 g | 2.0 g |
| Sodium sulfite | 30 g | 30 g |
| Potassium hydroquinonemonosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyarzolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water (make up to) | 1,000 ml | 1,000 ml |
| pH (adjusted with sulfuric acid or potassium hydroxide) | 9.60 | 9.60 |
| Reversal solution | | |
| Pentasodium nitrilo-N,N,N-trimethylenephosphonic acid | 3.0 g | 3.0 g |
| Tin (II) chloride dihydrate | 1.0 g | 1.0 g |
| p-Aminophenol | 0.1 g | 0.1 g |
| Sodium hydroxide | 8 g | 8 g |
| Glacial acetic acid | 15 ml | 15 ml |
| Water (make up to) | 1,000 ml | 1,000 ml |
| pH (adjusted with acetic acid or sodium hydroxide) | 6.00 | 6.00 |
| Color developing solution | | |
| Pentasodium nitrilo-N,N,N-trimethylenephosphonic acid | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfoamidoethyl)-3-methyl-4-aminoaniline.3/2 sulfate monohydrate | 11 g | 11 g |
| 3,6-Dithiaoctane-1,8-diol | 1.0 g | 1.0 g |
| Sulfate salt of hydroxylamine | 2.4 g | 2.8 g |
| Water (make up to) | 1,000 ml | 1,000 ml |
| pH (adjusted with sulfuric acid or potassium hydroxide) | 11.80 | 12.00 |
| Pre-bleaching solution | | |
| Disodium ethylenediaminetetraacetate | 8.0 g | 8.0 g |
| Sodium sulfite | 6.0 g | 6.0 g |
| 1-Thioglycelol | 0.4 g | 0.4 g |
| Adducts of formaldehyde with sodium bisulfite | 30 g | 35 g |
| Water (make up to) | 1,000 ml | 1,000 ml |
| pH (adjusted with acetic acid or sodium hydroxide) | 6.30 | 6.10 |

-continued

| | Tank | Replenisher |
|---|---|---|
| Bleaching solution | | |
| Disodium ethylenediaminetetraacetate dihydrate | 2.0 g | 4.0 g |
| Ammonium dihydrate salt of iron (III) ethylendiaminetetraacetate | 120 g | 240 g |
| N-ethyl-N-(β-methanesulfoamidoethyl)-3-methyl-4-aminoaniline · 3/2 sulfate monohydrate | 11 g | 11 g |
| 3,6-Dithiaoctane-1,8-diol | 1.0 g | 1.0 g |
| Sulfate salt of hydroxylamine | 2.4 g | 2.8 g |
| Water (make up to) | 1,000 ml | 1,000 ml |
| pH (adjusted with sulfuric acid or potassium potassium hydroxide) | 11.80 | 12.00 |
| Pre-bleaching solution | | |
| Disodium ethylenediaminetetraacetate | 8.0 g | 8.0 g |
| Sodium sulfite | 6.0 g | 6.0 g |
| 1-Thioglycelol | 0.4 g | 0.4 g |
| Adducts of formaldehyde with sodium bisulfite | 30 g | 35 g |
| Water (make up to) | 1,000 ml | 1,000 ml |
| pH (adjusted with acetic acid or sodium hydroxide) | 6.30 | 6.10 |
| Bleaching solution | | |
| Disodium ethylenediaminetetraacetate dihydrate | 2.0 g | 4.0 g |
| Ammonium dihydrate salt of iron( III) ethylenediaminetetraacetate | 120 g | 240 g |
| Potassium bromide | 100 g | 200 g |
| Ammonium nitrate | 10 g | 20 g |
| Water (make up to) | 1,000 ml | 1,000 ml |
| pH (adjusted with nitric acid or sodium hydroxide) | 5.70 | 5.50 |
| Fixing solution | | |
| Ammonium thiosulfate | 80 g | 80 g |
| Sodium sulfite | 5.0 g | 5.0 g |
| Sodium bisulfite | 5.0 g | 5.0 g |
| Water (make up to) | 1,000 ml | 1,000 ml |
| pH (adjusted with acetic acid or ammonium water) | 6.60 | 6.60 |
| Stabilizing solution | | |
| 1,2-Benzisothiazoline-3-on | 0.02 g | 0.03 g |
| Polyoxyethylene-p-monononylphenyl ether (average polymerization degree: 10) | 0.02 g | 0.03 g |
| Polymaleic acid (average molecular weight: 2,000) | 0.1 g | 0.15 g |
| Water (make up to) | 1,000 ml | 1,000 ml |
| pH | 7.0 | 7.0 |

Evaluation of samples

With respect to each of the samples, the minimum density of the yellow image and the maximum density of the magenta image were measured. The values were compared with the values of the sample No. 101 to obtain the differences (ΔDmin and ΔDmax). The value of ΔDmin corresponds to the remaining color of the dye after the process. The results are set forth in Table 4.

Further, green sensitivities of the samples were determined. The green sensitivity is a reciprocal value of the exposure that forms a magenta color density of the fogging value plus 0.2. The results are set forth in Table 4. In Table 4, the green sensitivities are expressed as relative values where the sensitivity of the sample No. 101 is 100%.

Furthermore, the samples were stored at 50° C. and the relative humidity of 80% for 3 days. The change of the minimum density of the yellow color was measured. The change of the blue sensitivity was also measured. The blue sensitivity was obtained from the density of the yellow color. The results are set forth in Table 4.

TABLE 4

| Sample No. | Yellow filter layer | Green sensitivity | Yellow color (Δ Dmin) | Magenta color (Δ Dmax) | Change of yellow color | Change of blue sensitivity |
|---|---|---|---|---|---|---|
| 101 | Silver* | 100% | — | — | 0.00 | 100% |
| 102 | Dye a | 89% | 0.12 | 0.16 | +0.02 | 98% |
| 103 | Dye b | 93% | 0.04 | 0.16 | +0.18 | 89% |
| 104 | Dye c | 98% | 0.10 | 0.18 | +0.02 | 93% |
| 105 | Dye d | 102% | 0.05 | 0.09 | +0.08 | 63% |
| 106 | Dye e | 110% | 0.05 | 0.18 | +0.09 | 93% |
| 107 | Dye 1 | 112% | 0.00 | 0.20 | +0.00 | 100% |
| 108 | Dye 5 | 115% | 0.01 | 0.18 | +0.01 | 100% |
| 109 | Dye 30 | 107% | 0.00 | 0.18 | +0.02 | 98% |

(Remark)
Silver*: Yellow colloidal silver

As is evident from the results of Table 4, the comparative dyes have some problems. In more detail, it was difficult to remove the dye, the yellow fog was increased, or the sensitivity was reduced. On the other hand, the dyes of the present invention are free from the problems. Further, the dyes of the invention can form a high color density.

EXAMPLE 2

Color negative photographic materials (disclosed in Example of Japanese Patent Provisional Publication No. 6(1994)-118563) were prepared using the solid dye dispersions A to H used in Example 1. The photographic materials were evaluated in the same manner as in Example 1. As a result, the dyes of the present invention 1, 5 and 30 are superior to the comparative dyes a to e in the same manner as in the results shown in Table 4.

EXAMPLE 3

Preparation of silver halide emulsion

The following solutions 1 to 3 were prepared.

Solution 1

| | |
|---|---|
| Water | 1.0 1 |
| Gelatin | 20 g |
| Sodium chloride | 20 g |
| Sodium 1,3-dimethylimidazolidine-2-thion | 20 mg |
| Sodium benzenthiosulfonate | 6 mg |

Solution 2

| | |
|---|---|
| Water | 400 ml |
| Silver nitrate | 100 g |

Solution 3

| | |
|---|---|
| Water | 400 ml |
| Sodium chloride | 30.5 g |
| Potassium bromide | 14.0 g |
| 0.001% Aqueous solution of potassium hexachloroiridate (III) | 10 ml |
| 0.001% Aqueous solution of potassium hexachlororhodate (III) | 10 ml |

To the solution 1 at 38° C. and pH of 4.5, the solutions 2 and 3 were simultaneously added for 10 minutes while stirring to form core grains having the average grain size of 0.16 μm. Further, the following solutions 4 and 5 were added to the mixture for 10 minutes. To the mixture, 0.15 g of potassium iodide was added to complete the grain formation.

Solution 4

| | |
|---|---|
| Water | 400 ml |
| Silver nitrate | 100 g |

Solution 5

| | |
|---|---|
| Water | 400 ml |
| Sodium chloride | 30.5 g |
| Potassium bromide | 14.0 g |
| 0.1% Aqueous solution of potassium hexacyanoferrate (II) | 10 ml |

The emulsion was washed with water according to a conventional flocculation method. To the emulsion, 30 g of gelatin was added.

The emulsion was adjusted to pH 5.5 and pAg 7.5. To the emulsion, 7.4 mg of sodium thiosulfate and 12.4 mg of chloroauric acid were added. The emulsion was chemically sensitized at 65° C. to obtain the optimum sensitivity. As a result, a silver iodochlorobromide cubic emulsion was obtained. The silver chloride content was 80 mol%. The average grain size was 0.20 μm.

Preparation of coating solution of emulsion layer

To the prepared silver halide emulsion, 0.05% methanol solution of the following sensitizing dye was added. The amount of the sensitizing dye was $5\times10^{-4}$ mol per 1 mol of silver halide.

Sensitizing dye

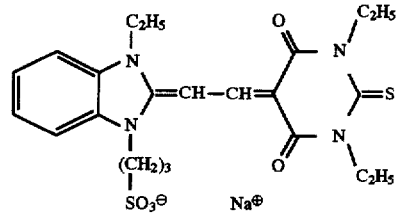

Preparation of dye dispersion

With 57.8 g of water, 2.5 g of the dye set forth in Table 5 and 3 g of 25% aqueous solution of a surface active agent (Demol SNB, Kao Co., Ltd.) were mixed. The mixture was placed in a sand grinder mill (1/16 G, Imex) containing glass beads having diameters in the range of 0.8 to 1.2 mm. The mixture was dispersed at 1,500 rpm to obtain a dispersion of fine crystals of the dye. The particle size of the dispersion was not larger than 1 μm.

Preparation of photographic materials 301 to 308

The following dye, emulsion and protective layers were simultaneously coated on a support having the following backing layers to obtain photographic materials 301 to 308.

Protective layer

| | |
|---|---|
| Gelatin | 0.4 g/m² |
| Polymethyl methacrylate particles (particle size: 2.5 μm) | 60 mg/m² |
| Colloidal silica (particle size: 10 μm) | 70 mg/m² |
| Sodium dodecylbenzensulfonate | 40 mg/m² |

Emulsion layer

| | |
|---|---|
| Gelatin | 1.0 g/m² |
| Emulsion (coated silver amount) | 3.0 g/m² |

-continued

| | |
|---|---|
| Hydroquinone | 0.1 g/m² |
| Polyethyl acrylate latex | 0.25 g/m² |
| 2-Bis(vinylsulfonylacetamido)ethane | 86 mg/m² |

Dye layer

| | |
|---|---|
| Gelatin | 0.5 g/m² |
| Dye | Set forth in Table 5 |
| Sodium dodecylbenzensulfonate | 20 mg/m² |
| Sodium polystyrenesulfonate | 45 mg/m² |
| 2-Bis(vinylsulfonylacetamido)ethane | 31 mg/m² |
| Set forth in Table Set forth in Table 5 | |

Support

Polyethylene terephthalate film (thickness: 100 μm) having undercoating layers on the both sides Backing layer

| | |
|---|---|
| Gelatin | 2.2 g/m² |
| Sodium dodecylbenzensulfonate | 80 mg/m² |
| 1,3-Divinylsulfone-2-propanol | 60 mg/m² |

Protective backing layer

| | |
|---|---|
| Gelatin | 0.5 g/m² |
| Polymethyl methacrylate particles (particle size: 4.7 μm) | 30 mg/m² |
| Sodium dodecylbenzensulfonate | 20 mg/m² |
| Fluorine-containing surface active agent | 2.2 mg/m² |
| Silicone oil | 90 mg/m² |

Development of samples

The samples were exposed to xenon flash light through an interference filter having a peak at 488 nm. The exposed time was $10^{-5}$ second. The samples were then developed in an automatic developing machine (FG-710 NH, Fuji Photo Film Co. Ltd.) under the following conditions.

| Processing | Temperature | Time |
|---|---|---|
| Development | 38° C. | 20 seconds |
| Fixing | 37° C. | 9.7 seconds |
| Washing | 26° C. | 9 seconds |
| Squizing | | 2.4 seconds |
| Drying | 55° C. | 8.3 seconds |
| Total | | 43.4 seconds |

The compositions of the processing solutions are shown below.

Developing solution

| | |
|---|---|
| Potassium hydroxide | 35.0 g |
| Diethylenetriaminetetraacetic acid | 2.0 g |
| Sodium metabisulfite | 40.0 g |
| Potassium bromide | 3.0 g |
| Hydroquinone | 25.0 g |
| 5-Methylbenztriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazolinone | 0.04 g |
| Sodium 2-mercaptobenzimidazole-5-sulfonate | 0.15 g |
| Sodium erythrobate | 3.0 g |
| Water (make up to) | 1 liter |
| pH (adjusted with potassium hydroxide) | 10.5 |

Fixing solution

| | |
|---|---|
| Ammonium thiosulfate | 210 g |
| Sodium sulfite anhydride | 20 g |
| Diethylenetriaminetetraacetic acid | 0.1 g |
| Glacial acetic acid | 15 g |
| Water (make up to) | 1 liter |
| pH (adjusted with ammonium water) | 4.8 |

Evaluation of samples

The sensitivities of the samples were evaluated. The results are set forth in Table 5. In Table 5, the sensitivities are relative values where the sensitivity of the sample No. 301 is 100.

Further, three sheets of the samples was laminated. The lamination was observed with naked eyes to determine the remaining color within the highlight area. The results are set forth in Table 5. In Table 5, A means that the remaining color was not observed, and B means that the remaining color was observed.

TABLE 5

| Sample | Dye layer | | | Remaining |
|---|---|---|---|---|
| No. | Dye | Amount | Sensitivity | color |
| 301 | Dye 1 | 125 mg/m² | 100 | A |
| 302 | Dye 4 | 125 mg/m² | 102 | A |
| 303 | Dye 5 | 125 mg/m² | 99 | A |
| 304 | Dye 6 | 125 mg/m² | 96 | A |
| 305 | Dye 20 | 125 mg/m² | 104 | A |
| 306 | Dye j | 125 mg/m² | 101 | B |
| 307 | Dye g | 250 mg/m² | 60 | A |
| 308 | None | — | 120 | A |

Comparative dye j

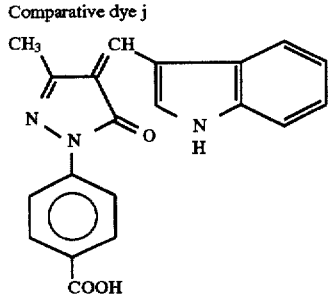

Comparative dye g

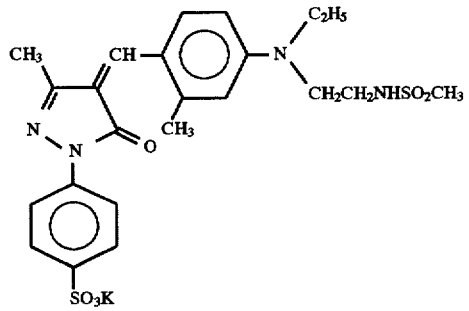

As is evident from the results of Table 5, the samples No. 301 to No. 305 of the present invention has a high sensitivity. Further, the samples of the invention form a clear image, wherein the remaining color is not observed. The image formed from the sample No. 308 having no dye was not clear.

EXAMPLE 4

Preparation of silver halide emulsion

To a gelatin solution (containing 1.55 of gelatin and 0.5 g per liter of sodium chloride) at 40° C., silver nitrate aqueous solution and sodium chloride aqueous solution (containing ammonium hexachlororhodate(III) in the amount of $7\times10^{-5}$ mol per 1 mol of silver) were added according to a double jet method to form a monodispersed silver chloride grains having the average grain size of 0.16 μm. The emulsion was desalted according to a conventional flocculation method. Gelatin was further added to the emulsion. Without a chemical sensitization, 4-hydroxy-6-methyl-1,3,3a,7-tetrazaindene ($6\times10^{-3}$ mol per 1 mol of silver) was added as a stabilizer to the emulsion. The emulsion was adjusted to the gelatin content of 49 g and silver content of 105 g based on 1 kg of the emulsion.

Preparation of samples

The following hydrazine derivative ($6\times10^{-3}$ mol per 1 mol of silver) was added to the prepared silver halide emulsion.

Hydrazine derivative

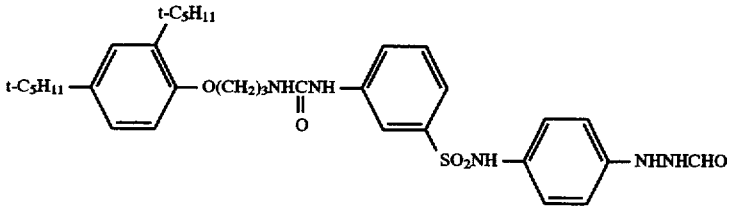

To the emulsion, polyethyl acrylate dispersion (20 g per 1 mol of silver) and 1,3-vinylsulfonyl-2-propanol (40 mg per 1 g of gelatin) as hardening agent were add to prepare a coating solution.

The coating solution was coated on a polyethylene terephthalate film to form a silver halide emulsion layer. The coated silver amount was 3.6 g/m$^2$.

Further, a gelatin dispersion of a dye set forth in Table 6 was coated on the emulsion layer to form a protective layer. The protective layer comprises 1.0 g/m$^2$ of gelatin, 50 mg/m$^2$ of polymethyl methacrylate particles (average particle size: 2.5 μm), sodium dodecylbenzensulfonate as coating aid and Potassium N-perfluorooctanesulfonyl-N-propylburysine as antistatic agent. Further, the protective layers of the samples No. 401 to 407 contain 40 mg/m$^2$ of the solid dispersion of the dye h.

Dye h

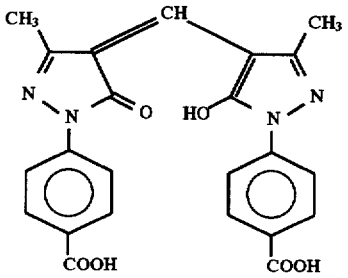

Development of samples

The samples were exposed to light through an optical wedge in a printer (P-627FM, Dai-Nippon Screen Co., Ltd.). The samples were then developed with the following developing solution at 34° C. for 30 seconds. The samples were then fixed, washed with water and dried.

Developing solution

| | |
|---|---|
| Potassium hydroxide | 90.0 g |
| Sodium hydroxide | 8.0 g |
| Disodium ethylenediaminetetracetate | 1.0 g |
| Boric acid | 24.0 g |
| Sodium metabisulfite | 65.0 g |
| Potassium bromide | 10.0 g |
| Hydroquinone | 55.0 g |
| 5-Methylbenztriazole | 0.40 g |
| N-methyl-p-aminophenol | 0.50 g |
| Sodium 2-mercaptobenzimidazole-5-sulfonate | 0.30 g |
| Sodium 3-(5-mercaptotetrazole)benzensulfonate | 0.20 g |
| N-n-butyl diethanolamine | 14.0 g |
| N,N-dimethylamino-6-hexanol | 0.20 g |
| Sodium toluenesulfonate | 8.0 g |
| 5-Sulfosalicylate | 23.0 g |
| Water (make up to) | 1 liter |
| pH (adjusted with potassium hydroxide) | 11.9 |

The relative sensitivities and the remaining color of the samples were evaluated in the same manner as in Example 4. The relative sensitivities are relative values where the sensitivity of the sample No. 401 was 100. The results are set forth in Table 6.

TABLE 6

| Sample | Protective layer | | | Remaining |
|---|---|---|---|---|
| No. | Dye | Amount | Sensitivity | color |
| 401 | Dye 1 | 55 mg/m$^2$ | 100 | A |
| 402 | Dye 4 | 55 mg/m$^2$ | 102 | A |
| 403 | Dye 5 | 55 mg/m$^2$ | 101 | A |
| 404 | Dye 6 | 55 mg/m$^2$ | 98 | A |
| 405 | Dye 20 | 55 mg/m$^2$ | 98 | A |
| 406 | Dye j | 55 mg/m$^2$ | 98 | B |
| 407 | Dye i | 50 mg/m$^2$ | 70 | A |
| 408 | None | — | 120 | A |

Comparative dye j

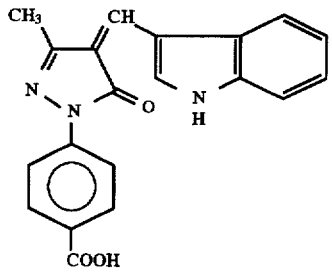

TABLE 6-continued

| Sample No. | Protective layer Dye | Amount | Sensitivity | Remaining color |
|---|---|---|---|---|
| Comparative dye i | | | | |

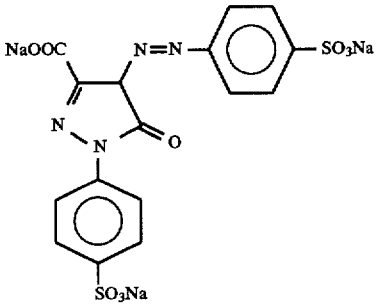

As is evident from the results of Table 6, the samples No. 401 to No. 405 of the present invention has a high sensitivity. Further, the samples of the invention form a clear image, wherein the remaining color is not observed. In the image formed from the sample No. 408 having no dye, a fog was observed within the highlight area.

We claim:

1. A silver halide photographic material comprising at least one silver halide emulsion layer and at least one non-light-sensitive hydrophilic colloidal layer provided on a support, wherein the silver halide emulsion layer or the hydrophilic colloidal layer contains a dye represented by the formula (I):

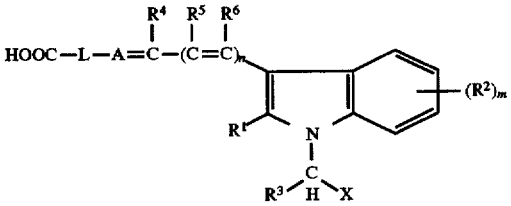

(I)

in which L is a single bond, a divalent aliphatic group, a divalent aromatic group or a combination thereof; A is a five- or six-membered nitrogen containing heterocyclic ring; $R^1$ is hydrogen, an aliphatic group, an aromatic group, an alkoxycarbonyl group, an aryloxycarbonyl group, an alkoxy group, an aryloxy group, an acyloxy group, a sulfonyloxy group, a carbamoyloxy group, a carbamoyl group, a halogen atom, hydroxyl or carboxyl; $R^2$ is an aliphatic group, an aromatic group, an acyl group, a sulfonyl group, an alkoxycarbonyl group, an aryloxycarbonyl group, an alkoxy group, an aryloxy group, an acyloxy group, a sulfonyloxy group, a carbamoyloxy group, amino, a substituted amino group, a heterocyclic group, an amido group, a carbamoyl group, a sulfonamido group, a halogen atom, hydroxyl, nitro, cyano or carboxyl; $R^3$ is hydrogen, an aliphatic group, an aromatic group or a halogen atom; each of $R^4$, $R^5$ and $R^6$ independently is hydrogen, an alkyl group, cyano or a halogen atom; m is an integer of 0 to 4; when m is 2, 3 or 4, the groups represented by $R^2$ may be different from each other; n is 0 or 1; and X is an electron attractive group having a Hammett's substituent constant ($\sigma^m$) of 0.3 to 1.5.

2. The silver halide photographic material as claimed in claim 1, wherein L is a divalent aromatic group.

3. The silver halide photographic material as claimed in claim 1, wherein A is 5-pyrazolone ring, hydroxypyridone ring, pyrazolopyridone ring or barbituric acid ring.

4. The silver halide photographic material as claimed in claim 3, wherein A is 5-pyrazolone ring.

5. The silver halide photographic material as claimed in claim 1, wherein $R^1$ is hydrogen, an aliphatic group, an aromatic group, an alkoxycarbonyl group or an aryloxycarbonyl group.

6. The silver halide photographic material as claimed in claim 1, wherein $R^2$ is an aliphatic group, an aromatic group, an alkoxy group, an acyloxy group, amino, a substituted amino group, a heterocyclic group, an amido group, a carbamoyl group, a halogen atom, nitro or carboxyl.

7. The silver halide photographic material as claimed in claim 1, wherein $R^3$ is hydrogen, an alkyl group or an aryl group.

8. The silver halide photographic material as claimed in claim 1, wherein each of $R^4$, $R^5$ and $R^6$ is hydrogen.

9. The silver halide photographic material as claimed in claim 1, wherein m is an integer of 0, 1 or 2.

10. The silver halide photographic material as claimed in claim 1, wherein n is 0.

11. The silver halide photographic material as claimed in claim 1, wherein X is a halogen atom, trifluoromethyl, cyano, formyl, an acyl group, an acyloxy group, carboxyl, an alkoxycarbonyl group, an aryloxycarbonyl group, an alkylcarbamoyl group, nitro, an alkylsulfinyl group, an alkylsulfonyl group or a sulfamoyl group.

12. The silver halide photographic material as claimed in claim 11, wherein X is an alkoxycarbonyl group or cyano.

13. The silver halide photographic material as claimed in claim 1, wherein the dye is insoluble in water or has a solubility of not more than 1.0 g per 1 liter of water at 25° C.

14. The silver halide photographic material as claimed in claim 1, wherein the dye is in the form of solid particles which are dispersed in the silver halide emulsion layer or the hydrophilic colloidal layer.

15. The silver halide photographic material as claimed in claim 14, wherein the particles of the dye have an average diameter in the range of 0.005 to 10 μm.

16. The silver halide photographic material as claimed in claim 1, wherein the dye is contained in the silver halide emulsion layer or the hydrophilic colloidal layer in an amount of 0.5 to 1,000 mg/m$^2$.

17. The silver halide photographic material as claimed in claim 1, wherein the dye is contained in the hydrophilic colloidal layer which functions as a yellow filter layer.

* * * * *